US008302959B2

(12) United States Patent
Ikeuchi et al.

(10) Patent No.: US 8,302,959 B2
(45) Date of Patent: Nov. 6, 2012

(54) REMAINING SHEET VOLUME DETECTING APPARATUS AND IMAGE FORMING APPARATUS

(75) Inventors: Hiroyuki Ikeuchi, Kanagawa (JP); Takuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 127 days.

(21) Appl. No.: 12/572,755

(22) Filed: Oct. 2, 2009

(65) Prior Publication Data

US 2010/0102505 A1 Apr. 29, 2010

(30) Foreign Application Priority Data

Oct. 27, 2008 (JP) ..... P2008-275728

(51) Int. Cl.
*B65H 1/18* (2006.01)

(52) U.S. Cl. ..... 271/152; 271/153; 271/154; 271/155

(58) Field of Classification Search ..... 271/152, 271/153, 154, 155
See application file for complete search history.

(56) References Cited

U.S. PATENT DOCUMENTS 4,815,725 A * 3/1989 Kanaya ..... 271/258.01
4,832,329 A * 5/1989 Rodi et al. ..... 271/155
4,919,410 A * 4/1990 Robinson et al. ..... 399/45
4,976,421 A * 12/1990 Kanaya ..... 271/258.01
5,556,252 A * 9/1996 Kuster ..... 414/796.7
5,839,015 A * 11/1998 Faguy et al. ..... 399/23
6,583,891 B2 * 6/2003 Joyce ..... 358/1.18
6,874,780 B2 * 4/2005 Rebeaud ..... 271/154
7,048,273 B2 * 5/2006 Meckes et al. ..... 271/258.01
7,726,645 B2 * 6/2010 Gerlier et al. ..... 271/122
2001/0042954 A1 * 11/2001 Rebeaud ..... 271/154

FOREIGN PATENT DOCUMENTS

JP 06100200 A * 4/1994
JP 10-181944 7/1998

* cited by examiner

*Primary Examiner* — Kaitlin Joerger
(74) *Attorney, Agent, or Firm* — Morgan, Lewis & Bockius LLP

(57) ABSTRACT

A remaining sheet volume detecting apparatus includes a loading unit that loads a sheet; a moving unit that moves the loading unit to a feed position of the loaded sheet; a feeding unit that feeds the sheet from the loading unit; a sheet thickness detecting unit that detects a thickness of the sheet; a load thickness detecting unit that detects that thickness of the loaded sheet within the loading unit, gradually decreasing; and a remaining sheet volume calculating unit that calculates a remaining volume within the loading unit based on the certain load thickness detected by the load thickness detecting unit and the sheet thickness detected by the sheet thickness detecting unit, each time a sheet is fed by the feeding unit after the load thickness detecting unit detects that the thickness of the loaded sheet within the loading unit has reached the certain load thickness.

9 Claims, 25 Drawing Sheets

UPON LOAD COMPLETION (TIMING E1)

UPON SPECIFIED LOAD THICKNESS DETECTION (TIMING E2)

UPON THIN PAPER FEED (TIMING E3)

UPON THICK PAPER FEED (TIMING E4)

UPON LOAD COMPLETION (TIMING J1)

UPON CERTAIN LOAD THICKNESS DETECTION (TIMING J2)

UPON THIN PAPER FEED (TIMING J3)

UPON THICK PAPER FEED (TIMING J4)

REMAINING SHEET VOLUME DETECTING APPARATUS AND IMAGE FORMING APPARATUS

CROSS-REFERENCE TO RELATED APPLICATION

This application is based on and claims priority under 35 USC 119 from Japanese Patent Application No. 2008-275728 filed on Oct. 27, 2008.

BACKGROUND

1. Technical Field

The present invention relates to a remaining sheet volume detecting apparatus and an image forming apparatus.

2. Related Art

Among various devices that load a sheet on a loading unit, feed the sheet loaded on the loading unit, and process the sheet, devices having a function to detect a remaining volume of sheets are known.

For example, in an image forming apparatus such as a printer or a compound device, a paper feed tray to load recording paper as the sheets is provided, but there is a function to detect and report a remaining volume of recording paper (sheets) loaded within the paper feed tray for the purpose of easily determining whether or not all pages can be printed when a document is printed.

SUMMARY

According to an aspect of the invention, a remaining sheet volume detecting apparatus includes a loading unit that loads a sheet; a moving unit that moves the loading unit to a feed position of a loaded sheet; a feeding unit that feeds the sheet from the loading unit reached the feed position; a sheet thickness detecting unit that detects a thickness of the sheet fed by the feeding unit; a load thickness detecting unit that detects that a sheet load thickness within the loading unit gradually decreasing according to the sheet feeding by the feeding unit reaches a certain load thickness; and a remaining sheet volume calculating unit that calculates a remaining volume of sheets within the loading unit based on the certain load thickness detected by the load thickness detecting unit and the sheet thickness detected by the sheet thickness detecting unit whenever a sheet is fed by the feeding unit after the load thickness detecting unit detects that the sheet load thickness within the loading unit has reached the certain load thickness.

BRIEF DESCRIPTION OF THE DRAWINGS

Exemplary embodiments of the invention will be described in detail based on the following figures, wherein.

DETAILED DESCRIPTION

Hereinafter, an exemplary embodiment of the present invention will be described in detail with reference to the accompanying drawings.

Exemplary Embodiment 1

Figure 1:
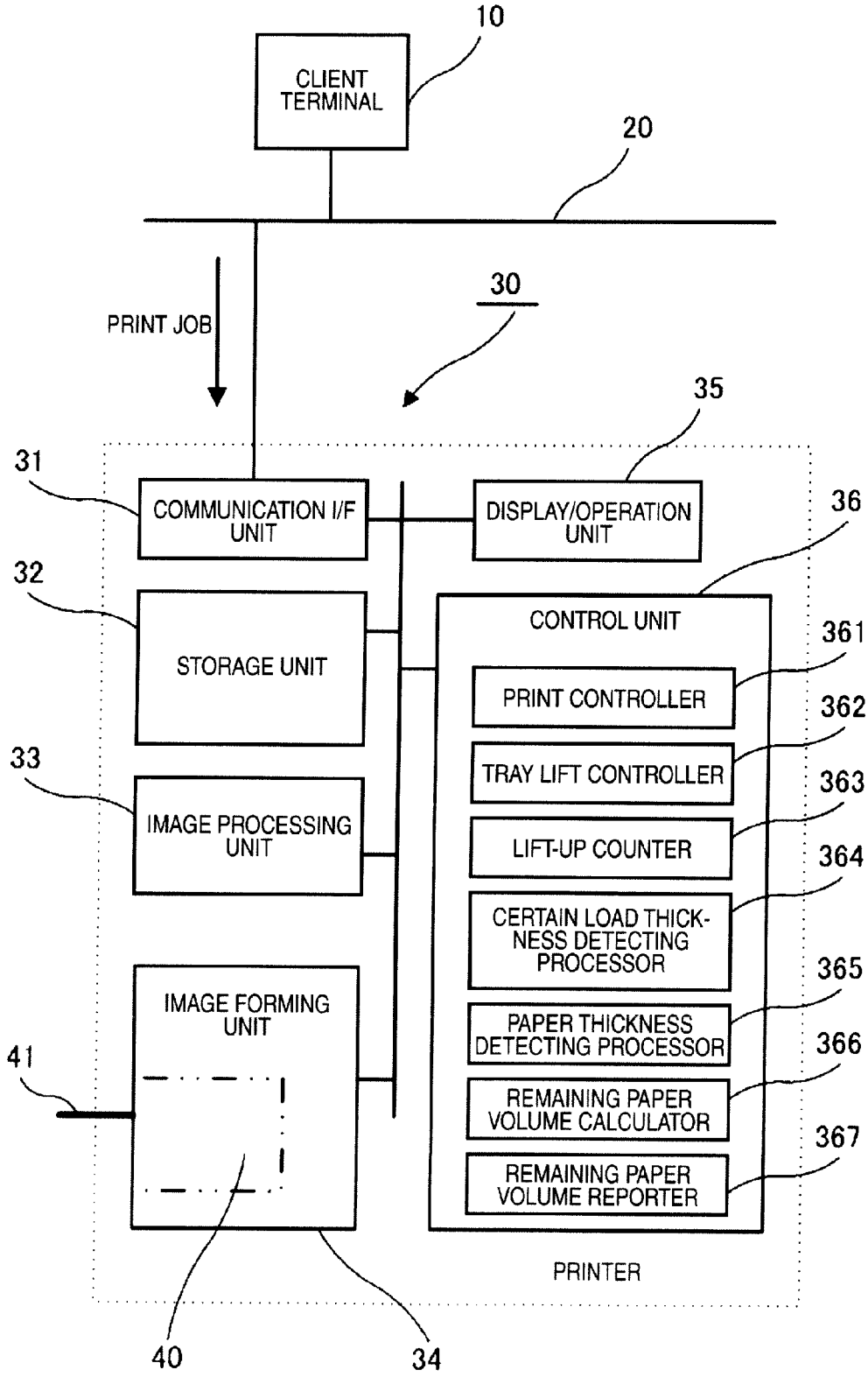
FIG. 1 is a block diagram showing a functional structure of a printer according to an exemplary embodiment 1.

FIG. 1 is a block diagram showing a function structure of a printer 30 according to an exemplary embodiment 1.

The printer 30 according to this exemplary embodiment includes a communication interface (I/F) unit 31 that is connected to one or more client terminals 10 including a PC (personal computer), etc., through a network (NW) 20 such as a LAN (Local Area Network) or a WAN (Wide Area Network) and is responsible for a communication interface upon communication with the client terminals 10 through the NW 20; a storage unit 32 that stores an operation program and various information such as document information (image data) of a print object included in a print instruction (print JOB) received from the client terminal 10 through the communication I/F unit 31; an image processing unit 33 that processes an image to generate print data from the document information (image data) of the print object stored in the storage unit 32; an image forming unit 34 that forms (prints) an image on a recording medium (recording paper) by executing an image forming process of electronic photography on the basis of print data generated by the image processing unit 33 and discharges (outputs) the image; a display/operation unit 35 including a display unit such as a liquid crystal display (LCD) and an operation unit having various operation keys such as a numeric keypad; and a control unit 36 that controls the entire apparatus.

The printer 30 is provided with a paper feed tray 41 that loads recording paper (hereinafter, paper) as a mechanism attached to the image forming unit 34, and a paper feeder 40 that feeds paper loaded on the paper feed tray 41 in synchronization with transfer timing of the image forming process.

Figure 2:
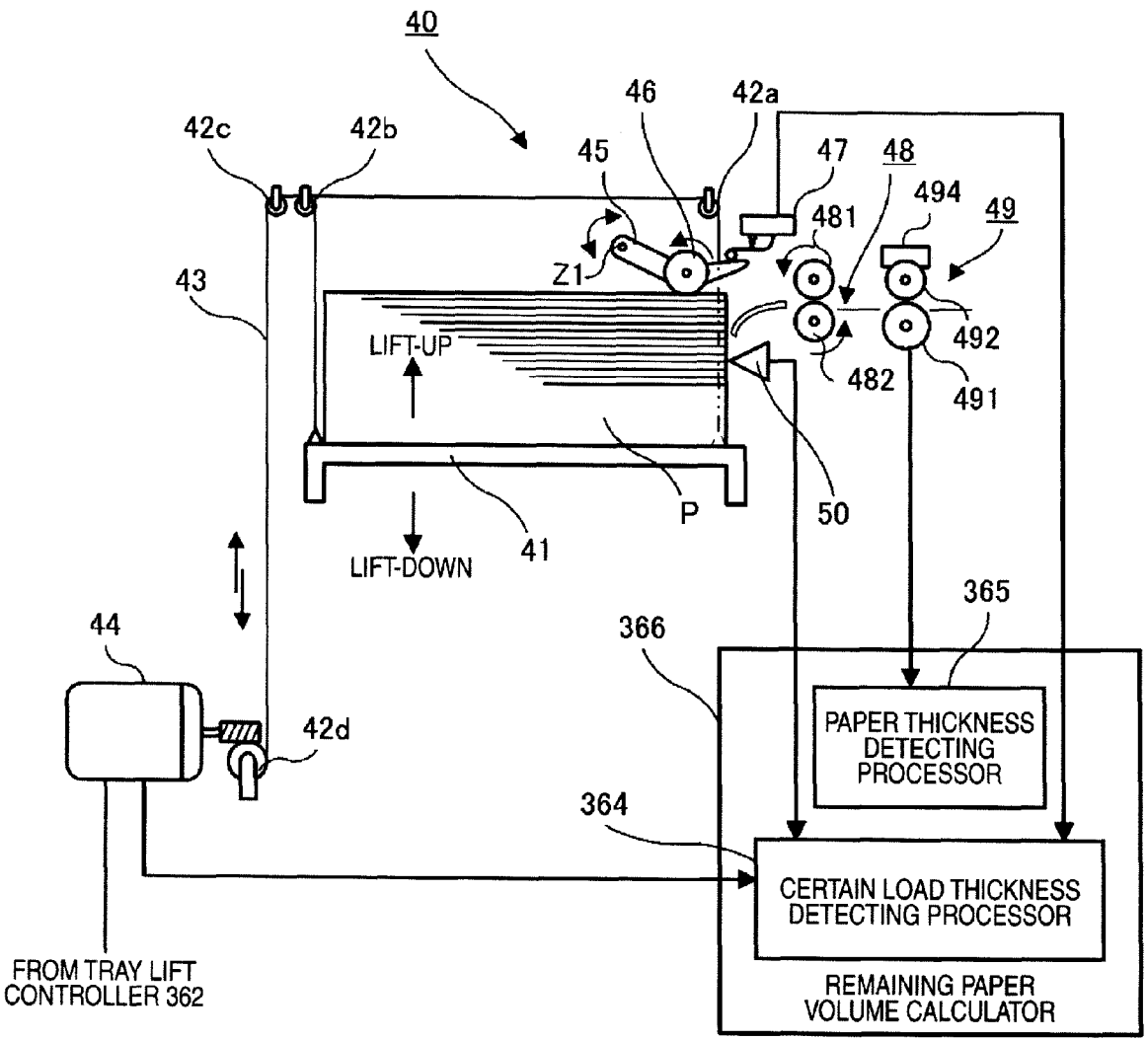
FIG. 2 is a diagram showing a schematic structure of a paper feeder of the printer according to the exemplary embodiment 1.

FIG. 2 is a diagram showing a schematic structure of the paper feeder 40 of the printer 30 according to this exemplary embodiment.

As shown in FIG. 2, the paper feeder 40 of the printer 30 includes a paper feed tray 41, mounted to an apparatus main body so as to be capable of being drawn from the apparatus main body, which may load paper (indicated by a sign P) in a state in which the paper feed tray 41 is drawn from the apparatus main body [which may selectively load (set) one or more types of paper pieces among various paper pieces of different types of size, thickness, or backing paper] and is provided to be lifted up from a position, in a state in which it is mounted to the apparatus main body, to a feed position of loaded paper; a wire 43 arranged across from an upper surface end of the paper feed tray 41 to a winding pulley 42*d* through pulleys 42*a*, 42*b*, and 42*c*; a tray lift drive mechanism, having a drive motor 44 to forwardly/reversely rotate the pulley 42*d*, which may lift up the paper feed tray 41, mounted to the apparatus main body, to the paper feed position after the load of paper, for example, by forwardly rotating the winding pulley 42*d* using the drive motor 44 and winding the wire 43, and lift down the paper feed tray 41 to a paper set position by reversely rotating the winding pulley 42*d* using the drive motor 44 and unwinding the wire 43; a delivery roller 46 which is rotatably supported to a cam 45 turning around an axis Z1 and sequentially delivers paper loaded on the paper feed tray 41 lifted up to the paper feed position from paper at the top position sheet by sheet; a limit sensor 47 which generates a detection output (changing from an off state to an on state) indicating the paper feed position (detects that the paper feed tray 41 has reached the paper feed position) by the fact that the paper at the top position is in contact with (pressed by) the other end of the cam 45 turning around the axis Z1 in an operation for pushing up the delivery roller 46 when the paper feed tray 41 is lifted up; a paper feed roller 48 which includes a drive roller 481 and a separation roller 482 (rotatable in a reverse direction to the drive roller 481 through a torque limiter) pressed to, and in contact with, the drive roller 481, introduces paper, delivered by the delivery roller 46 sheet by sheet from the paper feed tray 41 reached the paper feed position, between the two rollers 481 and 482 in synchronization with image transfer timing, and transports the paper in a transfer position direction; a paper thickness detecting roller 49 provided at a downstream side of a paper transport direction of the paper feed roller 48; a paper thickness sensor 494 which is attached to the paper thickness detecting roller 49 and detects a thickness of the paper transported by the paper feed roller 48; and a certain position detecting sensor 50 which detects that the paper feed tray 41 has reached a certain position.

Figure 3:
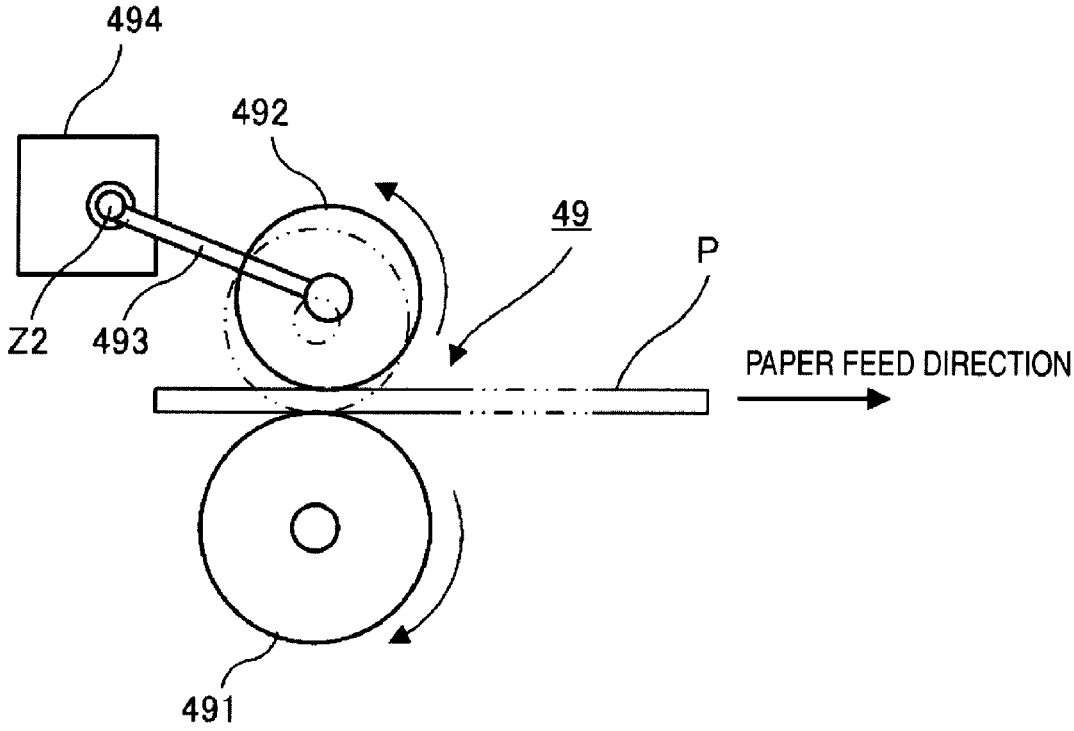
FIG. 3 is conceptual diagram showing a structure of a paper thickness detecting mechanism in the paper feeder.

In a structure of the paper feeder 40, for example, as shown in FIG. 3, the paper thickness detecting roller 49 includes a turning roller 491 which is rotatable and a movable roller 492 rotatably supported to a tip portion of a detecting lever 493 capable of turning around a rotary axis Z2 provided within the paper thickness sensor 494 and pressed by a predetermined pressure to be movable in a state of separation by a predetermined distance from a state in contact with the turning roller 491.

In FIG. 3, the paper thickness sensor 494 is a sensor, which detects a change in a rotation angle of the detecting lever 493 (the rotary axis Z2), for example, electromagnetically, when the detecting lever 493 turns after the movable roller 492 is operated (lifted up) according to a paper thickness when paper transported by the paper feed roller 48 passes through between the turning roller 491 and the movable roller 492. A detection output is sent to a paper thickness detecting processor 365.

The certain position detecting sensor 50 detects that the paper feed tray 41 has reached a certain position [a position where a paper load volume (paper load thickness) has reached a smaller regulation load thickness (certain load thickness) than a maximum load volume], and outputs a detection output as a start trigger of a remaining paper volume calculating process mode (see FIG. 8) to a certain load thickness detecting processor 364. For example, a near-empty sensor can be used, which detects a position where a paper load volume within the paper feed tray 41 becomes a given volume close to empty (near-empty), as the certain position.

In the printer 30 of this exemplary embodiment having the paper feeder 40 (see FIG. 2) of this structure, the control unit 36 (see FIG. 1) is provided with a print controller 361, a tray lift controller 362, a lift-up counter 363, the certain load thickness detecting processor 364, a paper thickness detecting processor 365, a remaining paper volume calculator 366, and a remaining paper volume reporter 367.

The print controller 361 receives a print instruction from the client terminal 10 through the communication I/F unit 31, generates print data by the image processing unit 33 from document information (image data) of a print object included in the print instruction, and controls an operation to print an image based on the print data on the paper by delivering and transporting the paper from the paper feed tray 41 in synchronization with image transfer timing after supplying the print data to the image forming unit 34 and initiating an electronic photography process.

For example, by performing a predetermined lift-up instruction operation by a user after the paper feed tray 41 where paper is set is mounted to the apparatus main body (or detecting that the paper feed tray 41 is mounted to the apparatus main body), the tray lift controller 362 performs a control operation to start the above-described forward rotation of the drive motor 44 and lift up the paper feed tray 41 until it is recognized that the paper feed tray 41 has reached a paper feed position on the basis of a detection output (for example, output "ON") of the limit sensor 47, a control operation to constantly maintain the paper feed tray 41 at the paper feed position by continuously lifting up the paper feed tray 41 until the output of the limit sensor 47 becomes "ON" whenever the detection output of the limit sensor 47 is lost (output "OFF") during a print operation due to the paper feed from the paper feed tray 41 lifted up to the paper feed position, and a control operation to reversely rotate the drive motor 44 and lift down the paper feed tray 41 to the paper set position (a position where drawing is possible) as described above by performing a predetermined lift-down instruction operation when paper for the paper feed tray 41 is set.

After the lift-up operation of the paper feed tray 41 is started by the drive motor 44, the lift-up counter 363 counts a lift-up operation time (lift-up time: accumulated lift-up time until the paper feed position is reached after paper setting and a lift-up time during printing performed in synchronization with the paper that is used by printing thus gradually decreasing a volume of loaded paper) until the paper feed tray 41 reaches the paper feed position (until an output of the limit sensor 47 becomes "ON").

The certain load thickness detecting processor 364 detects that a load thickness of paper within the paper feed tray 41 gradually decreasing according to the feeding of paper from the paper feed tray 41 becomes a certain load thickness.

Specifically, after the paper feed tray 41 starts to be lifted up by the drive motor 44, a load thickness of paper (a thickness of a total volume of paper) loaded on the paper feed tray 41 is detected on the basis of a movement amount of the paper feed tray 41 until the paper feed position is reached (an accumulated value of a movement amount until the paper feed position is reached and a movement amount until the paper feed position is reached by a lift-up operation in synchronization with paper feeding upon printing). When it is detected that the paper feed tray 41 has reached a certain position (near-empty position) on the basis of a detection output of the certain-position detecting sensor 50, a load thickness of paper within the paper feed tray 41 is detected as a certain load thickness.

In this case, the certain load thickness detecting processor 364 detects the above-described movement amount of the paper feed tray 41 as an operation time of the drive motor 44 until the paper feed position is reached, that is, a lift-up time counted by the lift-up counter 363, after the paper feed tray 41 starts to be lifted up.

In addition, the certain load thickness detecting processor 364 may be configured to register in advance the certain load thickness corresponding to the certain position of the paper feed tray 41 detected by the certain position detecting sensor 50, and read and detect the certain load thickness when the certain position detecting sensor 50 detects that the paper feed tray 41 has reached the certain position (near-empty position).

Whenever paper is delivered and transported (fed) from the paper feed tray 41 by printing sheet by sheet after the certain load thickness detecting processor 364 detects that a thickness of paper loaded on the paper feed tray 41 (a load thickness) is the certain load thickness, the paper thickness detecting processor 365 performs a process to detect a paper thickness during paper feeding on the basis of a detection output of the paper thickness sensor 494 (see FIG. 3) when the paper passes between the two rollers of the paper thickness detecting roller 49.

After the certain load thickness detecting processor 364 detects that the thickness of paper loaded on the paper feed tray 41 (the load thickness) is the certain load thickness, the remaining paper volume calculator 366 performs a process for calculating a remaining volume of paper loaded on the paper feed tray 41 on the basis of the certain load thickness detected by the certain load thickness detecting processor 364 and a thickness of fed paper detected by the paper thickness detecting processor 365.

The remaining paper volume reporter 367 reports the remaining paper volume to the user by displaying a remaining paper volume calculated by the remaining paper volume calculator 366, for example, on the display unit of the display/operation unit 35.

As described with reference to FIGS. 1 and 2, the printer 30 of this exemplary embodiment has a remaining sheet volume detecting apparatus including a loading unit (the paper feed tray 41) for loading a sheet (paper) as a recording medium; a moving unit (the tray lift controller 362) for moving the loading unit to a feed position of loaded paper; a feeding unit (the delivery roller 46 and the paper feed roller 48) for feeding paper from the loading unit reached the feed position; a sheet thickness detecting unit (the paper thickness sensor 494 and the paper thickness detecting processor 365) for detecting a thickness of paper fed by the feeding unit; a load thickness detecting unit (the certain position detecting sensor 50 and the certain load thickness detecting processor 364) for detecting that a paper load thickness within the loading unit gradually decreasing according to the paper feeding by the feeding unit reaches a certain load thickness; and a remaining paper volume calculating unit (the remaining paper calculator 366) for calculating a remaining volume of paper within the loading unit on the basis of the certain load thickness detected by the load thickness detecting unit and the paper thickness detected by the paper thickness detecting unit whenever paper is fed by the feeding unit after the load thickness detecting unit detects that the load thickness of paper within the loading unit has reached the certain load thickness.

Figure 4:
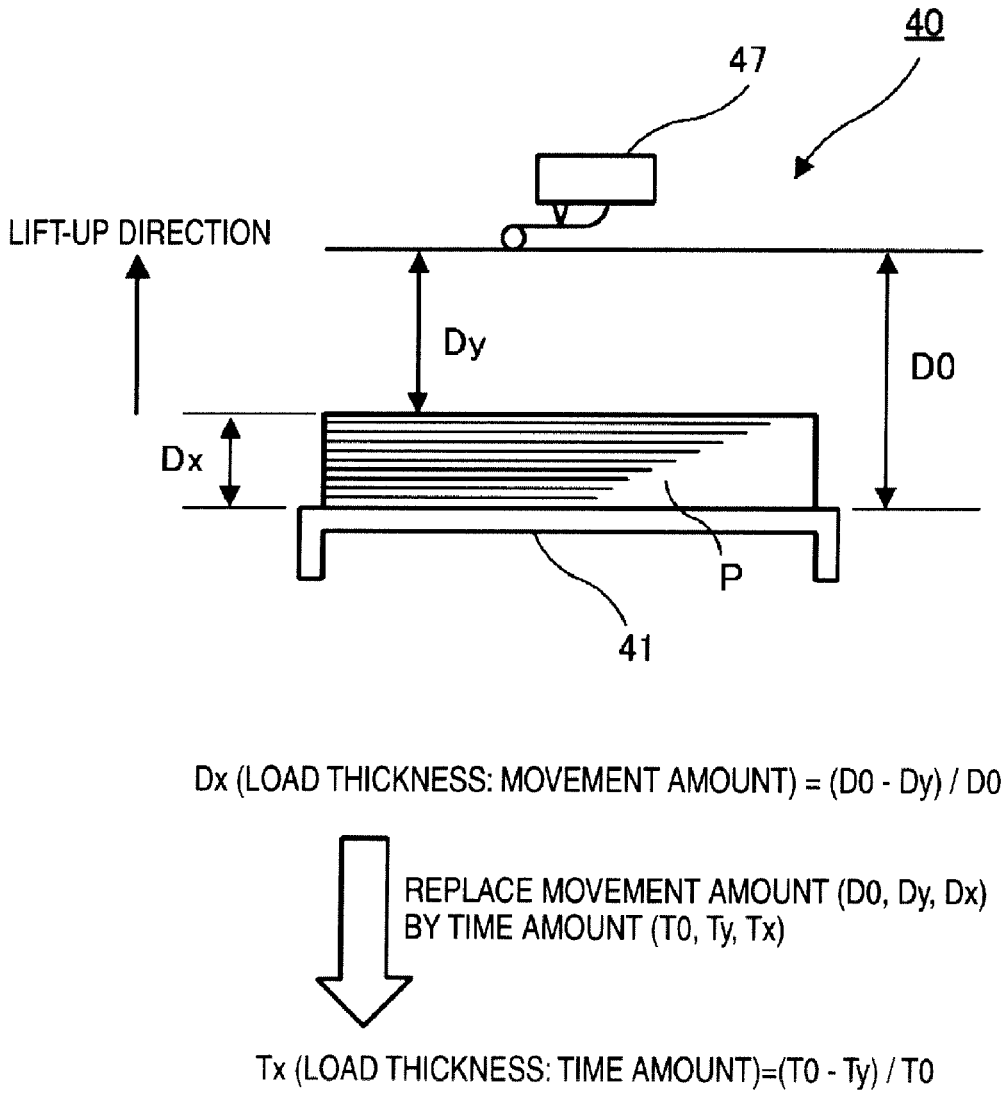
FIG. 4 is a conceptual diagram showing a principle of a paper load thickness detecting process according to the exemplary embodiment 1.

FIG. 4 is a conceptual diagram showing a principle of processing when the certain load thickness detecting processor 364 of the remaining sheet volume detecting apparatus provided in the printer 30 of this exemplary embodiment detects a load thickness of paper within the paper feed tray 41 on the basis of a movement amount of the paper feed tray 41.

In FIG. 4, D0 indicates a movement amount (distance amount) in which the paper feed tray 41 is movable by a lift-up operation from the origin position to the paper feed position in an empty state.

In FIG. 4, Dy indicates a movement amount (distance amount) in which the paper feed tray 41 is movable by the lift-up operation from the origin position to the paper feed position when paper of a thickness corresponding to a movement amount indicated by Dx of FIG. 4 is loaded on the paper feed tray 41.

In FIG. 4, the movement amount Dx (load thickness:movement amount) corresponding to the paper load thickness may be expressed as Dx=(D0−Dy).

Here, when Dx (load thickness:movement amount) is computed as a ratio to D0, Dx may be calculated by the following Expression (1).

$$Dx(\text{load thickness:movement amount})=(D0-Dy)/D0 \quad (1)$$

According to a drive mechanism of this exemplary embodiment that moves (lifts up) the paper feed tray 41 to be constantly maintained at the paper feed position, it may be considered that each of the movement amounts D0, Dy, and Dx is replaced with a lift-up time of the paper feed tray 41 in FIG. 4.

Here, for example, in FIG. 4, when D0 is set to a time amount T0 required to lift up the paper feed tray 41 when the paper feed tray 41 is in the empty state (a time amount until the paper feed tray 41 reaches the paper feed position after the paper feed tray 41 starts to be lifted up by the drive motor 44) and Dy is set to a time amount Ty for lifting up to the paper feed position in a state in which paper is loaded on the paper feed tray 41, a time amount Tx corresponding to the load thickness of paper loaded on the paper feed tray 41 is computed by the following Expression (2) when D0, Dy, and Dx of the above-described Expression (1) are respectively replaced with T0, Ty, and Tx.

$$Tx(\text{load thickness:time amount})=(T0-Ty)/T0 \quad (2)$$

Thereby, for example, when a lift-up time (accumulated value) to one timing of the paper feed tray 41 is 0.3 sec (Ty="0.3") if the paper feed tray 41 is lifted up in 3 sec in the empty state (Lift-Up Time T0="3"), a load thickness corresponding to ((3−0.3)/3=0.9), that is, a level of 9/10 (90 percent) of a load thickness (100 percent) corresponding to the maximum load volume ("Full" level) of the paper feed tray 41, is detected from the above-described Expression (2).

Likewise, when a lift-up time (accumulated value) to another timing of the paper feed tray 41 is 2.4 sec (Ty="2.4"), a load thickness corresponding to [(3−2.4)/3=0.2], that is, a level of 2/10 (20 percent) of the load thickness (100 percent) corresponding to the maximum load volume ("Full" level) of the paper feed tray 41, is detected from the above-described Expression (2).

In the following description, a load thickness of paper within the paper feed tray 41 is calculated on the basis of a lift-up time of the paper feed tray 41.

Figure 5A:
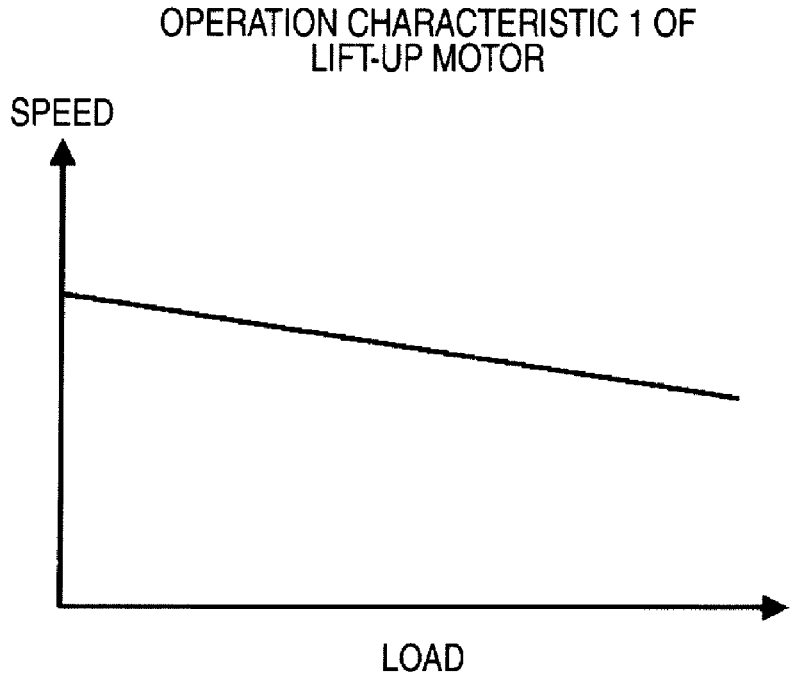
FIGS. 5A and 5B are diagrams showing operation characteristics of a drive motor for driving a paper feed tray.
Figure 5B:
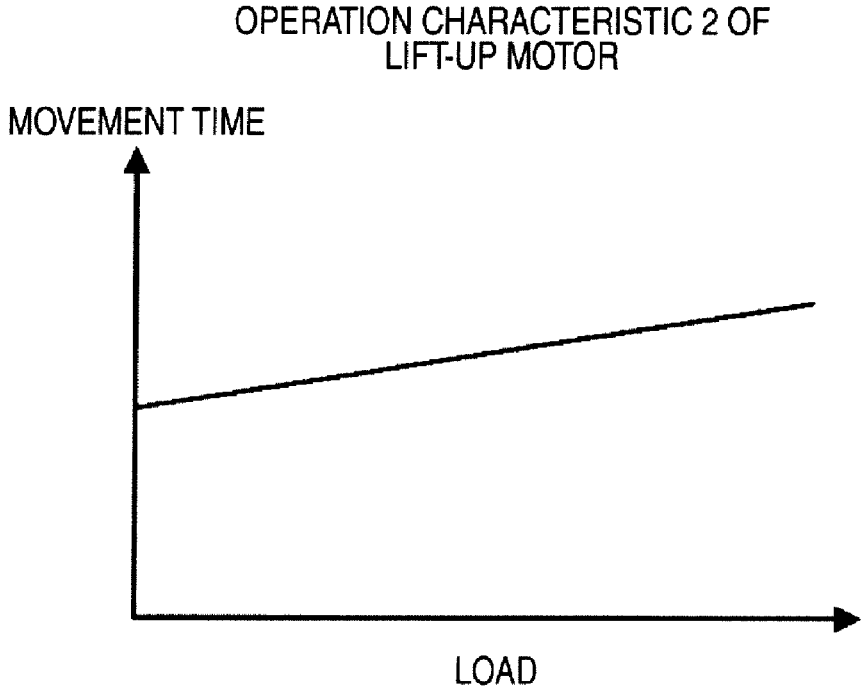

FIGS. 5A and 5B are diagrams showing operation characteristics of the drive motor (lift-up motor) 44 used in a lift-up/down operation of the paper feed tray 41 in the printer 30.

The drive motor 44 has a characteristic that a rotation speed decreases as a load (load volume of paper within the paper feed tray 41) increases as shown in FIG. 5A, and has a characteristic that a movement time of the paper feed tray 41 increases as the load increases with respect to the relationship of the movement time of the paper feed tray 41 to the load as shown in FIG. 5B.

Figure 6:
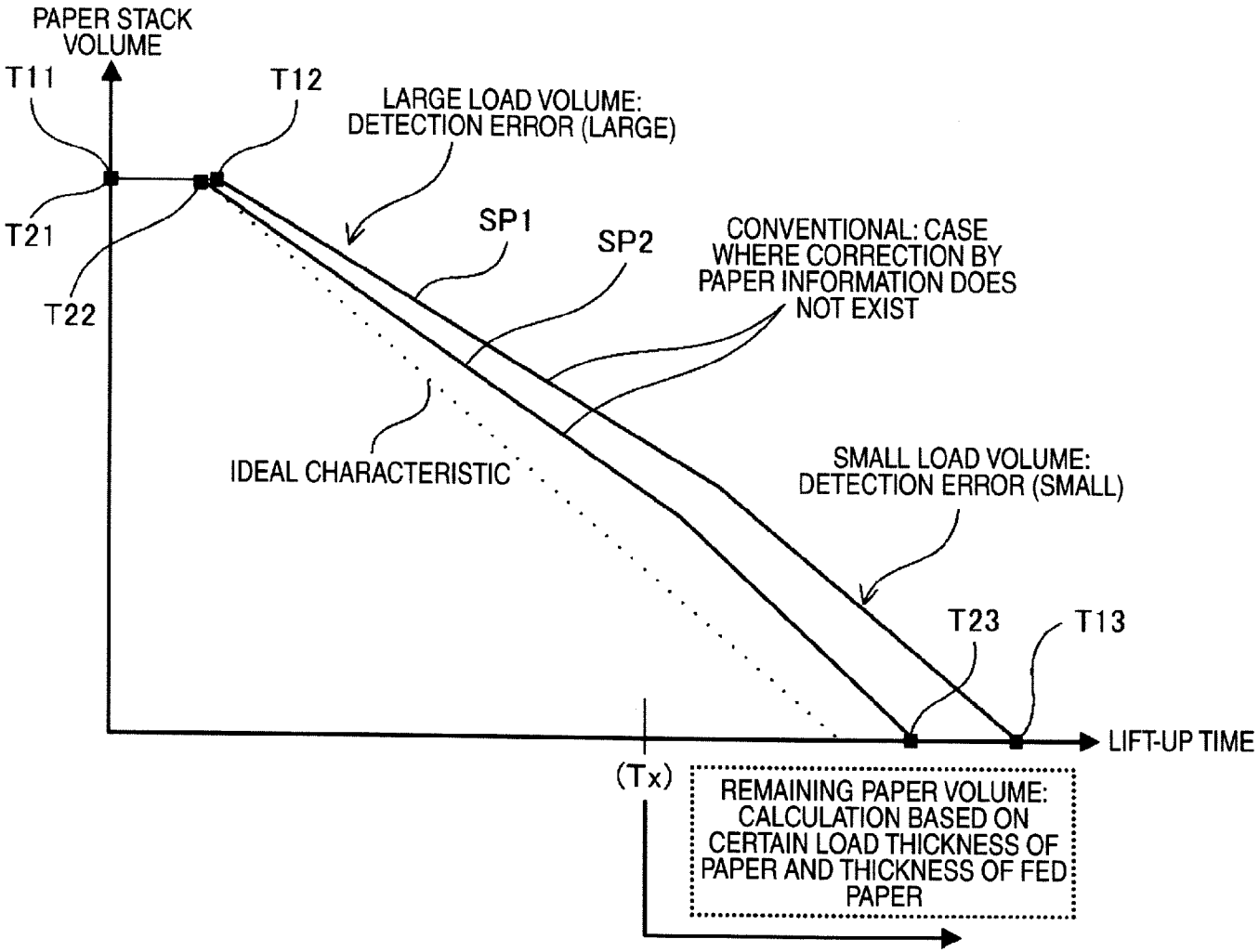
FIG. 6 is a diagram showing characteristics of a lift-up time to a paper stack volume of a related apparatus.

FIG. 6 is a diagram showing characteristics of a paper stack volume (load volume) within the paper feed tray 41 and a lift-up time when a paper thickness of paper within the paper feed tray 41 is detected on the basis of a lift-up time (only, correction by paper information, etc., is not performed) in the case where the paper feed tray 41 on which paper is set is lifted up using the drive motor 44 having the operation characteristics shown in FIGS. 5A and 5B.

In FIG. 6, a characteristic denoted by a sign SP1 is that corresponding to an operation transition state in which the paper feed tray 41 on which a large volume of paper of a large size (for example, A3 size) is loaded starts to be lifted up at timing T11, a lift-up operation to the paper feed position is completed at timing T12, printing is performed while the paper feed tray 41 is lifted up with paper feeding after timing T12, and there is no paper within the paper feed tray 41 at timing T13.

A characteristic denoted by a sign SP2 is that corresponding to an operation transition state in which the paper feed tray 41 on which a small volume of paper of a large size (for example, A3 size) is loaded starts to be lifted up at timing T21, a lift-up operation to the paper feed position is completed at timing T22, printing is performed while the paper feed tray 41 is lifted up with paper feeding after timing T22, and there is no paper within the paper feed tray 41 at timing T23.

Here, in the case where a load thickness of paper within the paper feed tray 41 is detected on the basis of a lift-up time when the paper feed tray 41 on which paper is set is lifted up, a characteristic that a constant lift-up time may be ideally detected during a lift-up operation regardless of a paper stack volume, with respect to a characteristic of a lift-up time to a paper stack volume, accurately may detect a load thickness of paper as shown in FIG. 6 (see the "ideal characteristic" shown in FIG. 6).

However, since the operation characteristics of the drive motor 44 shown in FIGS. 5A and 5B are reflected in actual operation, variation characteristics are shown where the lift-up time is lengthened when the paper stack volume increases and then the lift-up time is shortened when the paper stack volume gradually decreases as paper is consumed by printing (see the characteristics SP1 and SP2).

It is noted that the lift-up time is short and the detection error is small when the paper stack volume is small through examination of the characteristics shown in FIG. 6. In this exemplary embodiment, by the paper stack volume reaching the certain volume (indicated by a sign "Tx" in the figure) is detected, for example, from a detection output of the certain position detecting sensor 50. A thickness of fed paper is detected each time printing is executed after the paper stack volume is less than the certain volume, and an accurate remaining paper volume is detected from the paper stack volume of the above-described certain volume and the thickness of fed paper.

Hereinafter, a remaining paper calculating process will be described in detail on the basis of a remaining paper detecting method (detecting a remaining paper volume on the basis of a certain load thickness and an actually detected paper thickness after the paper stack volume has reached the certain load thickness).

Figure 7:
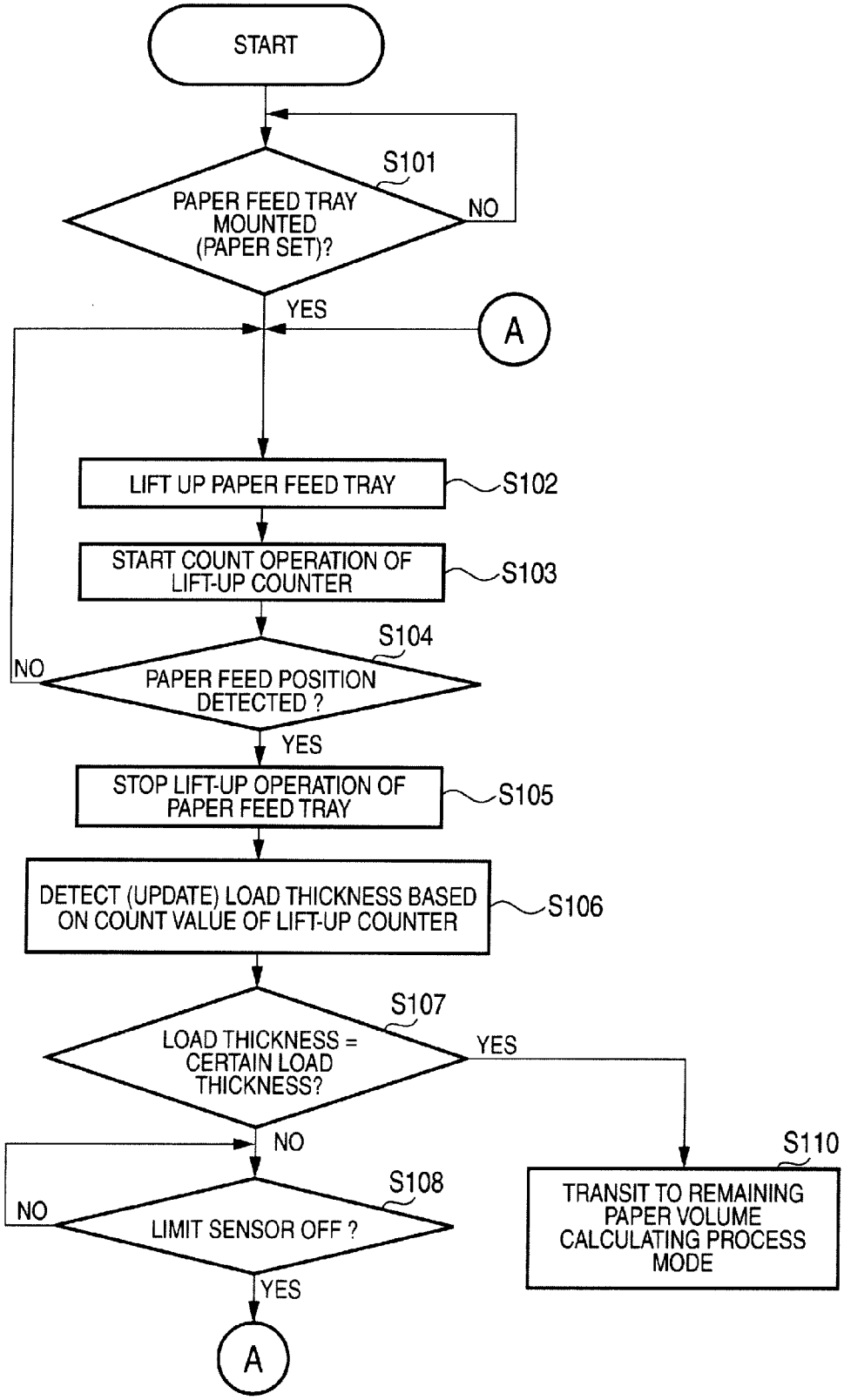
FIG. 7 is a flowchart showing a remaining paper volume calculating process operation of the apparatus according to the exemplary embodiment 1.

FIG. 7 is a flowchart showing a remaining paper calculation processing operation of the printer 30 according to this exemplary embodiment.

In particular, FIG. 7 considers a processing operation when the transition to the print operation is made by lifting up the paper feed tray 41 to the paper feed position after paper is loaded (set) on the paper feed tray 41 and feeding paper on the basis of a print instruction from the lift-up position.

As shown in FIG. 7, in the printer 30, the tray lift controller 362 monitors whether or not the paper feed tray 41 is mounted in a state in which the paper feed tray 41 is drawn from the apparatus main body (step S101).

Here, when the mounting of the paper feed tray 41 filled with paper is detected (step S101: YES), the tray lift controller 362 recognize that the output of the limit sensor 47 is "off" to start to lift up the paper feed tray 41 by rotating the drive motor 44 in a direction in which the wire 43 is wound by the winding pulley 42 by the winding pulley 42*d* (step S102).

Then, the tray lift controller 362 starts the lift-up counter 363 to count a time (lift-up time) from a start point at which the paper feed tray 41 is lifted up (step S103), and checks whether or not the paper feed tray 41 has reached the paper feed position by monitoring an output of the limit sensor 47 (step S104).

Here, in the case where it is determined that the paper position has not been reached by the fact that the output of the limit sensor 47 is "OFF" (step S104: NO), the lift-up operation of the paper feed tray 41 is continued (step S102).

In the case where it is determined that the paper feed position has been reached by the fact that the output of the limit sensor 47 is "ON" while the lift-up operation of the paper feed tray 41 is continued (step S104: YES), the tray lift controller 362 stops the lift-up operation of the paper feed tray 41 and the counting operation of the lift-up counter 363 (step S105) and proceeds to a load thickness detecting process.

When the transition to the load thickness detection process is made, the load thickness detecting processor 364 reads a count value (lift-up time) of the lift-up counter 363 at a point when the counting operation of the lift-up counter 363 is stopped in step S105, and detects a load thickness of paper within the paper feed tray 41 using the above-described Expression (2) on the basis of the lift-up time (step S106).

Subsequently, the certain load thickness detecting processor 364 checks whether or not the paper load thickness detected in step S106 has reached the certain load thickness (step S107).

Here, when it is determined that the load thickness of paper within the paper feed tray 41 has reached the certain load thickness by the fact that the certain position detecting sensor 50 detects that the paper feed tray 41 has reached the certain position (step S107: YES), the transition to a remaining paper volume calculating process mode is made (step S110).

A processing operation of the remaining paper volume calculating process mode will be described with reference to FIG. 8.

On the other hand, when it is determined that the load thickness of paper within the paper feed tray 41 has not reached the certain load thickness by the fact that the certain position detecting sensor 50 does not detect that the paper feed tray 41 has reached the certain position (step S107: NO), the tray lift controller 362 checks whether or not the output of the limit sensor 47 is "OFF" to cope with lift-up control for paper feeding by printing (step S108).

Here, when it is determined that the output of the limit sensor 47 is "OFF" as paper is fed by printing performed after step S105, the tray lift controller 362 proceeds to step S102, starts the drive motor 44 to lift up the paper feed tray 41 (step S102), and starts the lift-up counter 363 to count the lift-up time (step S103).

Meanwhile, the output of the limit sensor 47 is monitored, and the lift-up operation of the paper feed tray 41 is continued (step S102) while the output of the limit sensor 47 is "OFF" (step S104: NO). When the output of the limit sensor 47 is "ON", it is determined that the paper feed position has been reached (step S104: YES), the lift-up operation of the paper feed tray 41 and the counting operation of the lift-up counter 363 are respectively stopped (step S105), and the transition to the load thickness detection (update) process of step S106 is made.

When the transition to the load thickness detection (update) process is made, the certain load thickness detecting processor 364 computes an accumulated lift-up time by adding a count value (lift-up time) of the lift-up counter 363 when the counting operation is stopped in step S105 to a lift-up time of a previous lift-up operation of the paper feed tray 41, and updates a load thickness of paper within the paper feed tray 41 using the above-described Expression (2) on the basis of the accumulated lift-up time (step S106).

Thereafter, as described above, while the load thickness updated in step S106 does not reach the certain load thickness (step S107), the process of steps S102 to S106 [the process in which the paper feed tray 41 is lifted up until the output of the limit sensor 47 is "ON", the lift-up operation of the paper feed tray 41 is stopped when the output of the limit sensor 47 is "ON", an accumulated lift-up time is computed by adding a count value (lift-up time) of the lift-up counter 363 for the mean time to a lift-up time of the lift-up operation of the paper feed tray 41 up to a previous time, and a load thickness of paper within the paper feed tray 41 is updated using the above-described Expression (2) on the basis of the accumulated lift-up time] is continued whenever the output of the limit sensor 47 is "OFF" (YES in step S108).

Meanwhile, when the certain load thickness detecting processor 364 determines that the load thickness of paper within the paper feed tray 41 has reached the certain load thickness (step S107: YES) by the fact that the certain position detecting sensor 50 detects that the paper feed tray 41 has reached the certain position, the transition to the remaining paper volume calculating process mode is made (step S110).

Figure 8:
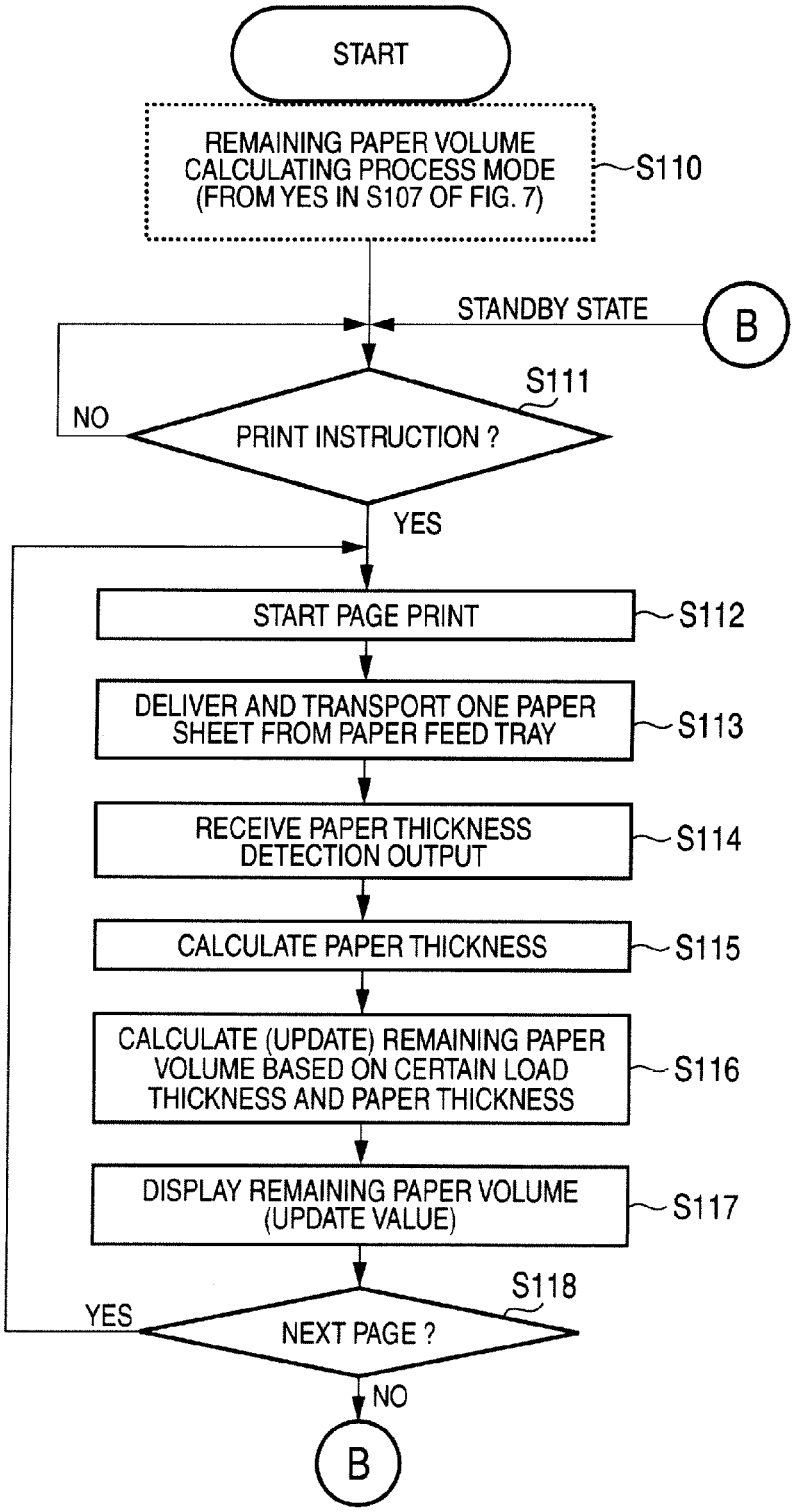
FIG. 8 is a detailed flowchart of a remaining paper volume calculating process mode of the apparatus according to the exemplary embodiment.

FIG. 8 is a flowchart showing a detailed processing operation of the remaining paper volume calculating process mode.

As shown in FIG. 8, when the transition to the remaining paper volume calculating process mode (step S110) is made, the print controller 361, for example, monitors whether or not there is a print instruction from the client terminal 10 (step S111), causes the image processing unit 33 to generate print data by extracting image information of a first page of a print-instructed document when the print instruction exists (step S111: YES), and starts print control of the page at the image forming unit 34 on the basis of the print data (step S112).

When paper feed timing is reached in the printing of the page after the print control is started, the print controller 361 causes the delivery roller 46 to deliver one sheet of paper from the paper feed tray 41 and then causes the paper feed roller 48 to transport the paper to a transfer position (step S113).

When paper passes through between the turning roller 491 and the movable roller 492 of the paper thickness detecting roller 49 during paper feeding (transport), the movable roller 492 is lifted up according to a thickness of the paper to turn the detecting lever 493, so that the paper thickness sensor 494 outputs a turning angle, that is, a thickness detection signal corresponding to the paper thickness.

Then, the paper thickness detecting processor 365 receives a thickness detection signal of the paper thickness sensor 494 (step S114) and detects a thickness of paper being transported on the basis of the thickness detection signal (step S115).

Subsequently, the remaining paper volume calculator 366 performs a process to calculate the remaining volume of paper currently loaded on the paper feed tray 41 on the basis of the certain load thickness detected by the certain load thickness processor 364 in step S106 of FIG. 7 and the thickness of the fed paper (one sheet) detected by the paper thickness detecting processor 365 in step S115 (step S116).

The remaining paper volume reporter 367 displays the remaining paper volume calculated in step S116 on the display unit of the display/operation unit 35 (step S117).

Continuously, the print controller 361 checks whether or not the next page exists (step S118), returns to step S112 when it is determined that the next page exists (step S118: YES), and starts the printing of the page (step S112).

Then, after a thickness of paper fed to print a corresponding page through steps S112 to S115 is detected in the same way after a first sheet starts to be printed, a corresponding remaining paper volume is updated by subtracting the detected thickness corresponding to one sheet of paper from a remaining paper volume calculated at the time (step S116) and the updated remaining paper volume is displayed on the display unit of the display/operation unit 35 (step S117).

Then, while a page of an object to be printed exists (step S118: YES), the update of the remaining paper volume (step S116) and the display of the updated remaining paper volume (step S117) are performed by repeating the process of steps S112 to S117. When it is determined that the next page does not exist (step S118: NO), the process is terminated and the transition to the standby state is made.

It is monitored whether or not a print instruction exists even in the standby state. Whenever the print instruction exists (step S111: YES), a process, which detects a thickness of fed paper, updates a corresponding remaining paper volume by subtracting the detected thickness corresponding to one sheet of the paper from a remaining paper volume at the time, and displays the updated remaining paper volume, is performed as described above (steps S112 to S118).

Next, high-precision remaining paper volume detection based on a remaining paper volume detecting method of this exemplary embodiment will be verified using a specific example.

Figure 9A:
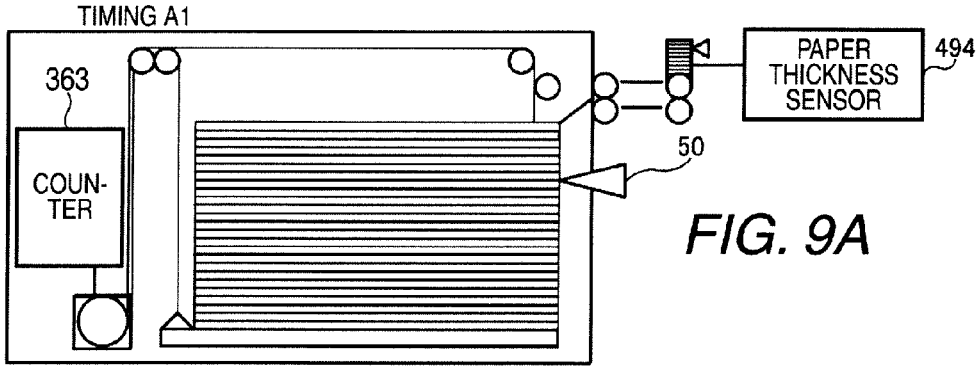
FIGS. 9A to 9D are conceptual diagrams showing operation transition states when a large volume of large size paper is loaded in the exemplary embodiment 1.
Figure 9B:
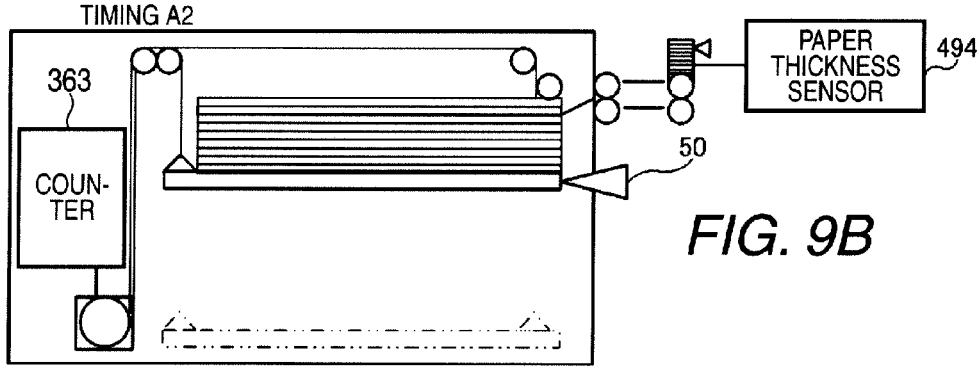
Figure 9C:
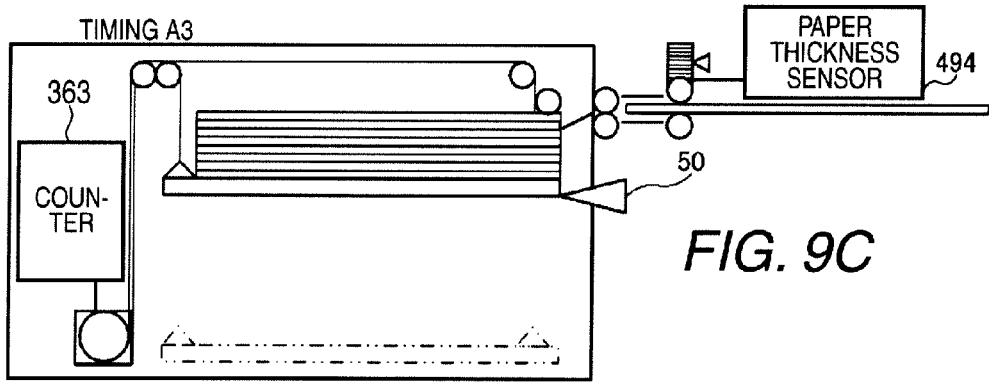
Figure 9D:
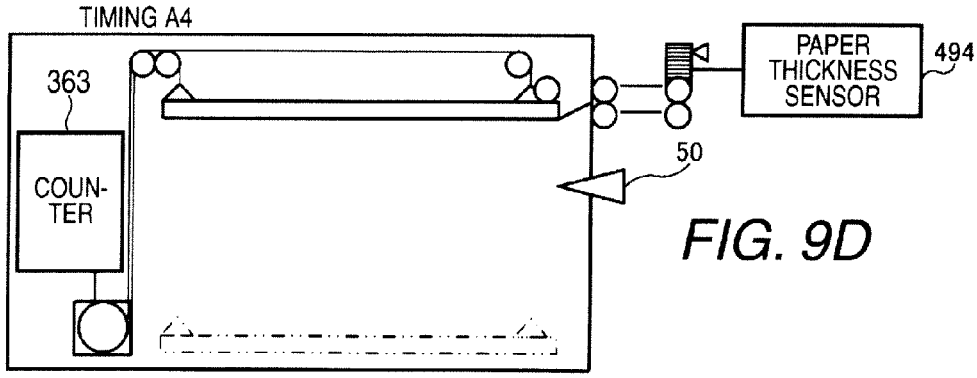

FIGS. 9A to 9D are specific examples of a remaining paper volume detecting process when a load volume is large, and illustrate operation transition states, for example, in which the paper feed tray 41 on which A3 size paper whose volume is close to the maximum load volume is loaded starts to be lifted up at timing A1 (see FIG. 9A), it is detected that a load thickness of paper within the paper feed tray 41 has reached the certain volume by referring to a detection output of the certain position detecting sensor 50 at timing A2 while an operation is continuously performed to lift up the paper feed tray 41 to the paper feed position in synchronization with paper feeding by printing even after the paper feed tray 41 is lifted up to the paper feed position (see FIG. 9B), the printing is executed while feeding paper and detecting a thickness of the paper after timing A3 (see FIG. 9C), and there is no paper within the paper feed tray 41 at timing A4 (see FIG. 9D).

Figure 10A:
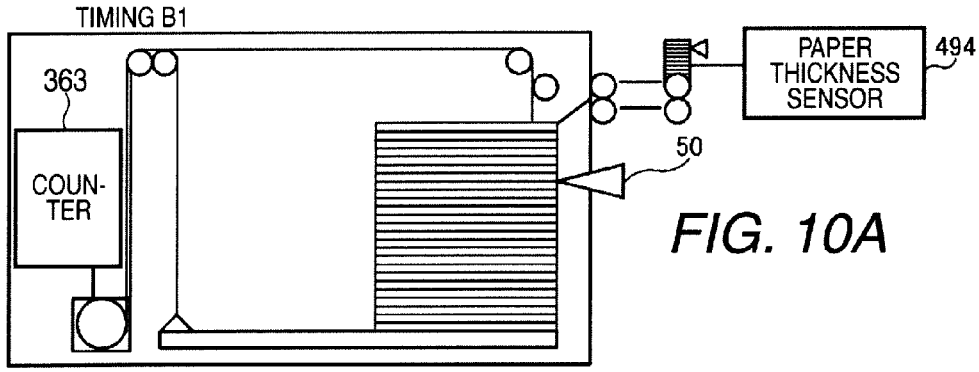
FIGS. 10A to 10D are conceptual diagrams showing operation transition states when a small volume of large size paper is loaded in the exemplary embodiment 1.
Figure 10B:
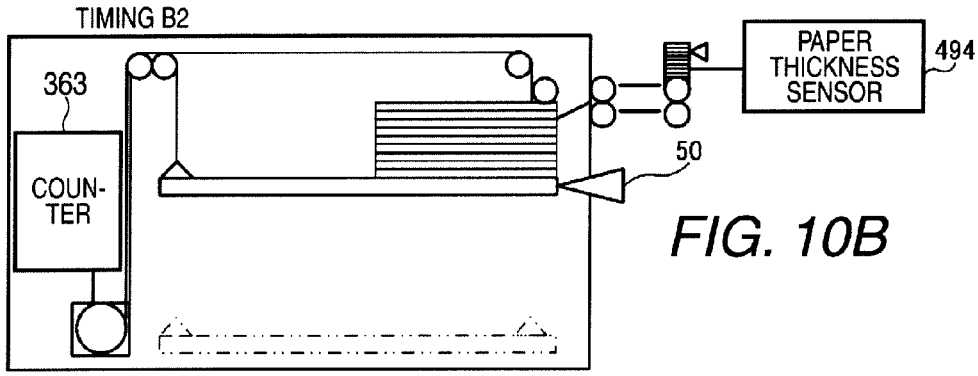
Figure 10C:
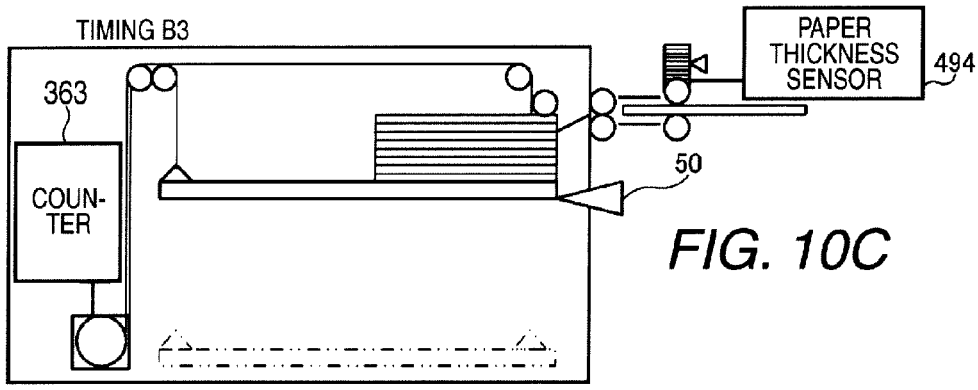
Figure 10D:
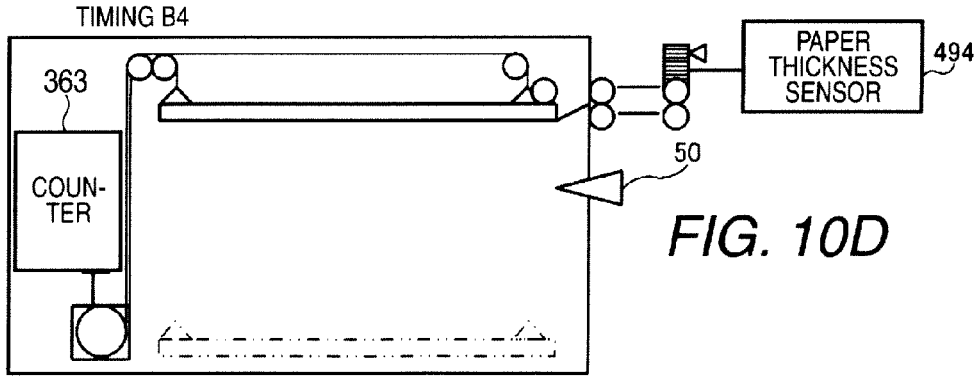

Likewise, FIGS. 10A to 10D are other specific examples of the remaining paper volume detecting process when the load volume is large, and illustrate operation transition states, for example, in which the paper feed tray 41 on which A4 size paper whose volume is close to the maximum load volume is loaded starts to be lifted up at timing B1 (see FIG. 10A), it is detected that a load thickness of paper within the paper feed tray 41 has reached the certain volume by referring to a detection output of the certain position detecting sensor 50 at timing B2 while an operation is continuously performed to lift up the paper feed tray 41 to the paper feed position in synchronization with paper feeding by printing even after the paper feed tray 41 is lifted up to the paper feed position (see FIG. 10B), the printing is executed while feeding paper and detecting a thickness of the paper after timing B3 (see FIG. 10C), and there is no paper within the paper feed tray 41 at timing B4 (see FIG. 10D).

Figure 11A:
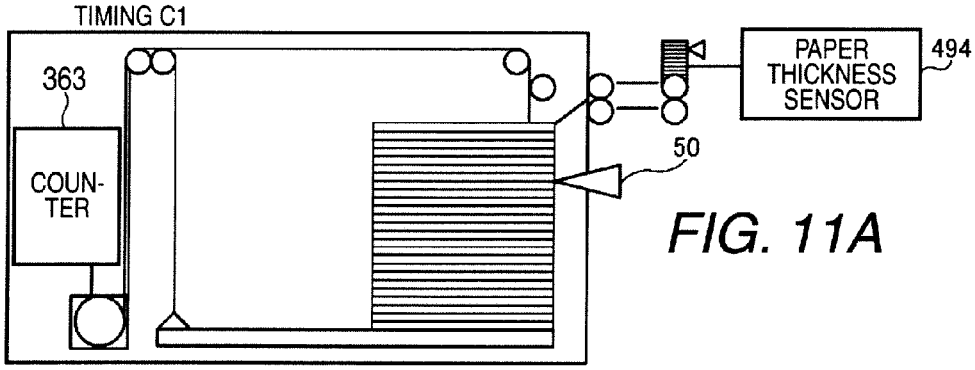
FIGS. 11A to 11D are conceptual diagrams showing operation transition states when a large volume of small size paper is loaded in the exemplary embodiment 1.
Figure 11B:
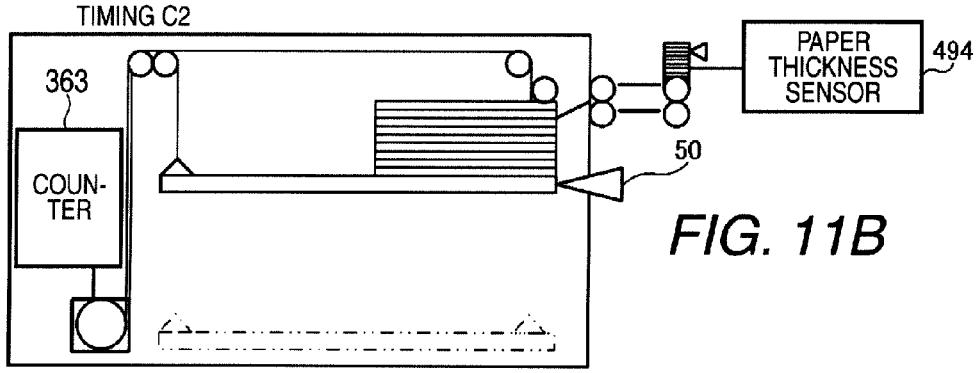
Figure 11C:
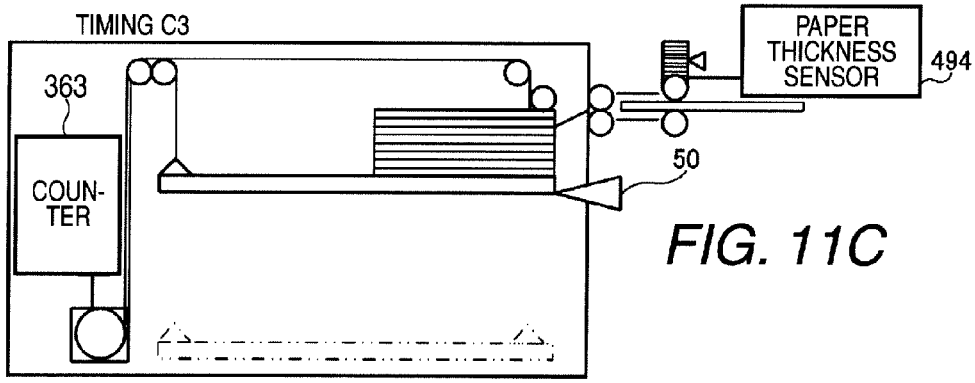
Figure 11D:
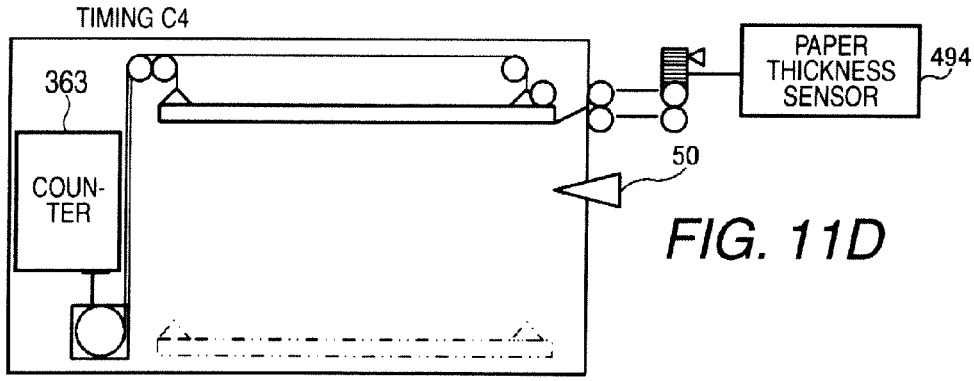

FIGS. 11A to 11D are specific examples of a remaining paper volume detecting process when a load volume is small, and illustrate operation transition states, for example, in which the paper feed tray 41 on which A3 size paper whose volume is close to near-empty is loaded starts to be lifted up at timing C1 (see FIG. 11A), it is detected that a load thickness of paper within the paper feed tray 41 has reached the certain volume by referring to a detection output of the certain position detecting sensor 50 at timing C2 while an operation is continuously performed to lift up the paper feed tray 41 to the paper feed position in synchronization with paper feeding by printing even after the paper feed tray 41 is lifted up to the paper feed position (see FIG. 11B), the printing is executed while feeding paper and detecting a thickness of the paper after timing C3 (see FIG. 11C), and there is no paper within the paper feed tray 41 at timing C4 (see FIG. 11D).

Figure 12A:
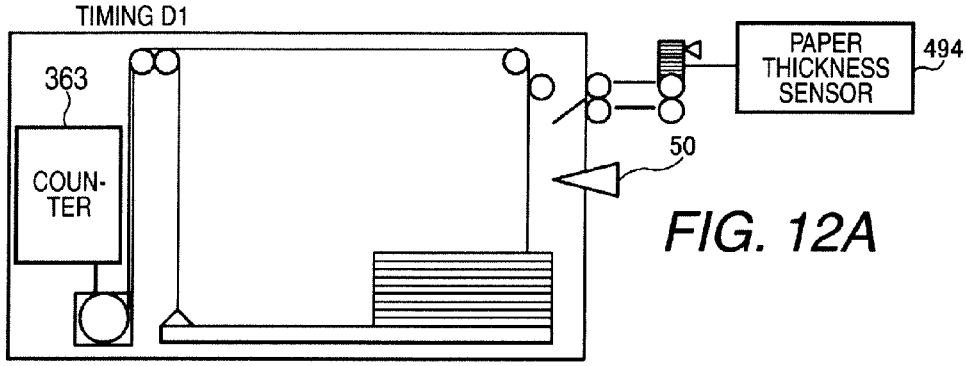
FIGS. 12A to 12D are conceptual diagrams showing operation transition states when a small volume of small size paper is loaded in the exemplary embodiment 1.
Figure 12B:
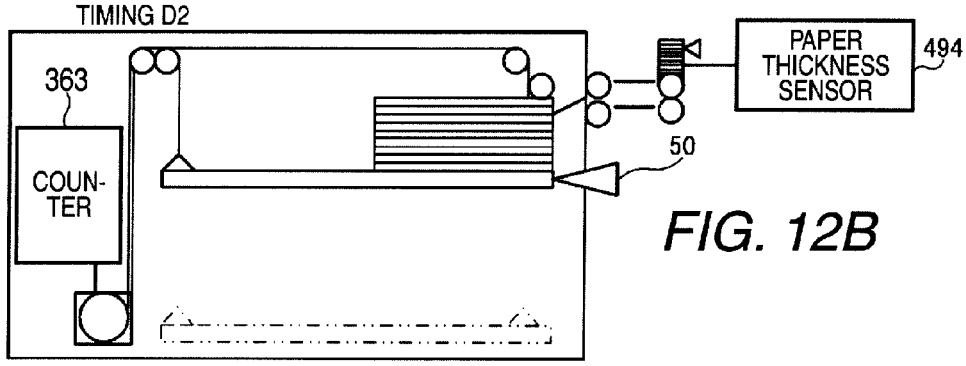
Figure 12C:
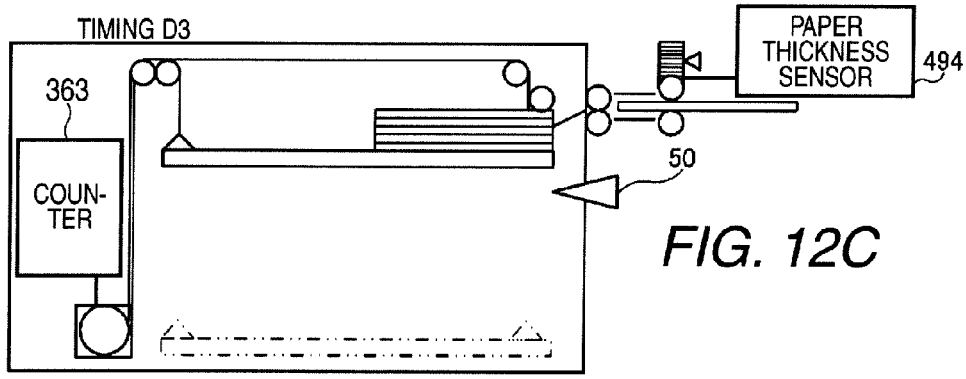
Figure 12D:
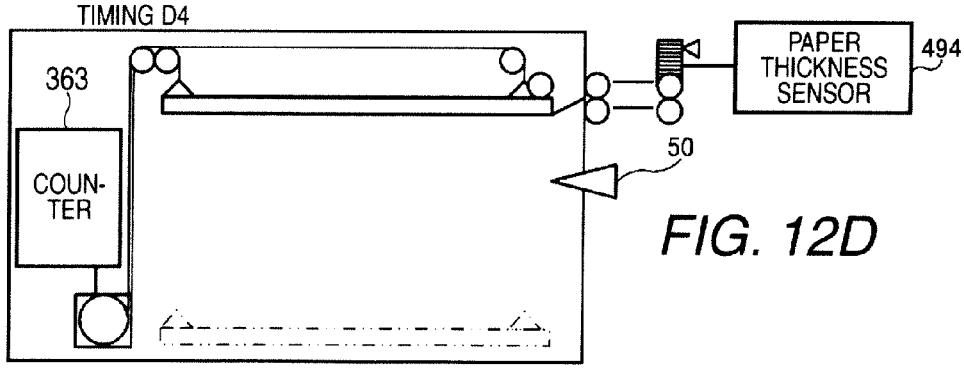

Likewise, FIGS. 12A to 12D are other specific examples of the remaining paper volume detecting process when the load volume is small, and illustrate operation transition states, for example, in which the paper feed tray 41 on which A4 size paper whose volume is close to near-empty is loaded starts to be lifted up at timing D1 (see FIG. 12A), it is detected that a load thickness of paper within the paper feed tray 41 has reached the certain volume by referring to a detection output of the certain position detecting sensor 50 at timing D2 while an operation is continuously performed to lift up the paper feed tray 41 to the paper feed position in synchronization with paper feeding by printing even after the paper feed tray 41 is lifted up to the paper feed position (see FIG. 12B), the printing is executed while feeding paper and detecting a thickness of the paper after timing D3 (see FIG. 12C), and there is no paper within the paper feed tray 41 at timing D4 (see FIG. 12D).

Figure 13:
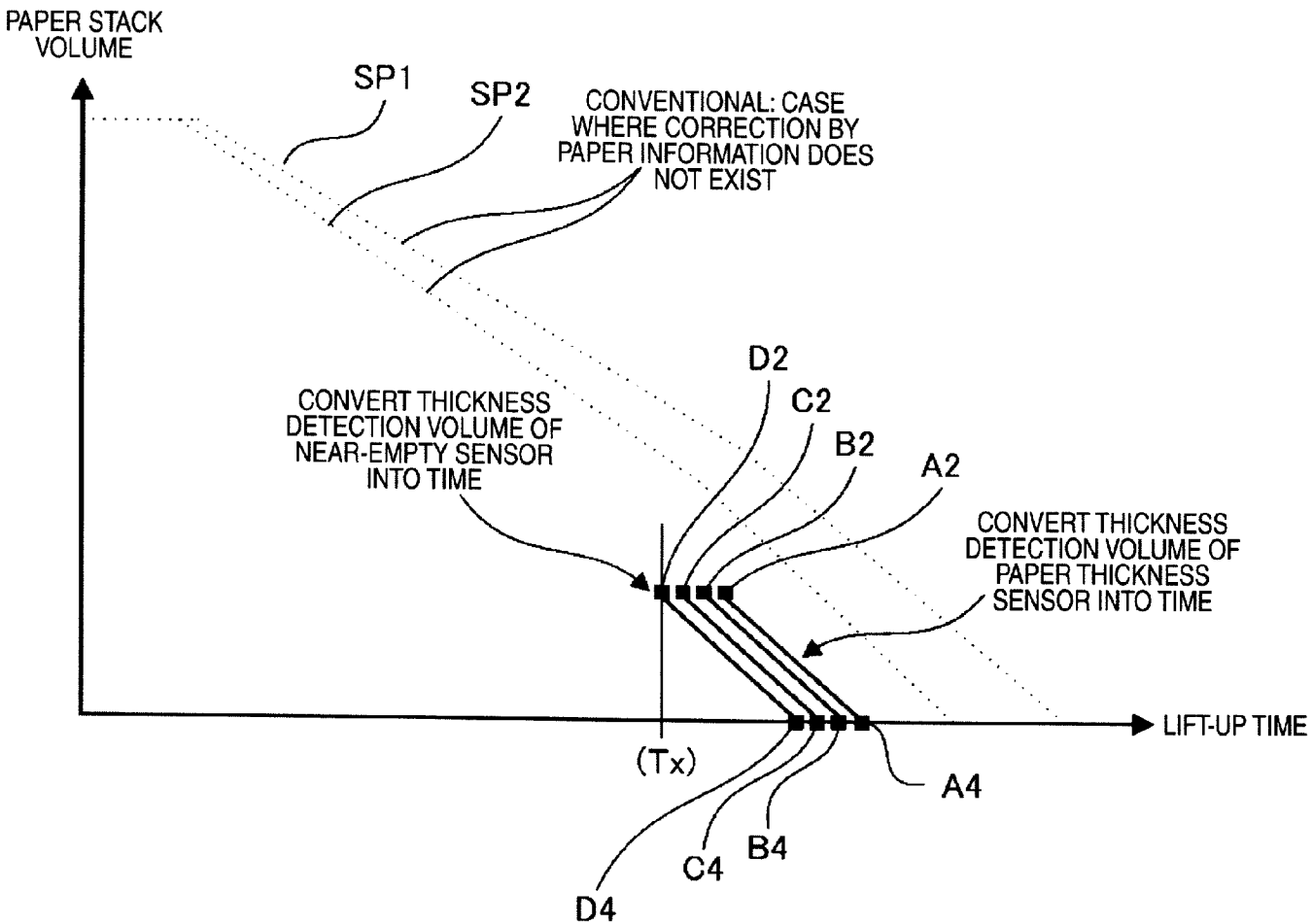
FIG. 13 is a diagram showing characteristics of a lift-up time to a paper stack volume of the apparatus according to the exemplary embodiment 1.

FIG. 13 is a diagram showing paper stack volume-lift up time characteristics of the paper feed tray 41 in the remaining sheet volume detecting apparatus mounted to the printer 30 according to this exemplary embodiment.

Signs A2, A4, B2, B4, C2, C4, D2, and D4 shown in FIG. 13 respectively correspond to timings A2, A4, B2, B4, C2, C4, D2, and D4 shown in FIGS. 9A to 12D.

In the manner of comparing with characteristics of this exemplary embodiment, characteristics of a lift-up time to a paper stack volume (only in the case where a paper stack volume is large) based on the related remaining sheet volume detecting method (only when correction by paper information, etc., is not performed) are indicated by the dotted line of FIG. 13.

As shown in FIG. 13, according to the remaining sheet volume detecting apparatus of this exemplary embodiment, a thickness of paper fed in synchronization with printing is detected by the paper thickness sensor 494 whenever the printing is executed in a period from timing A2 when it is detected that the load thickness of paper within the paper feed tray 41 has reached the certain load thickness to timing A4 when the paper feed tray 41 is completely lifted up (empty), for example, in an operation (a large size and large load) of the transition states shown in FIGS. 9A to 9D, according to the paper stack volume-lift up time characteristics indicated by the solid line, and a remaining paper volume calculating process is performed on the basis of the certain load thickness detected by the certain position detecting sensor 50 at timing A2 and the paper thickness detected by the paper thickness sensor 494 during paper feeding.

In an operation (a small size and large load) of the transition states shown in FIGS. 10A to 10D, a thickness of paper fed in synchronization with printing is detected by the paper thickness sensor 494 whenever the printing is executed in a period from timing B2 when it is detected that the load thickness of paper within the paper feed tray 41 has reached the certain load thickness to timing B4 when the paper feed tray 41 is completely lifted up (empty), and a remaining paper volume calculating process is performed on the basis of the certain load thickness detected by the certain position detecting sensor 50 at timing B2 and the paper thickness detected by the paper thickness sensor 494 during paper feeding.

In an operation (a large size and small load) of the transition states shown in FIGS. 11A to 11D, a thickness of paper fed in synchronization with printing is detected by the paper thickness sensor 494 whenever the printing is executed in a period from timing C2 when it is detected that the load thickness of paper within the paper feed tray 41 has reached the certain load thickness to timing C4 when the paper feed tray 41 is completely lifted up (empty), and a remaining paper volume calculating process is performed on the basis of the certain load thickness detected by the certain position detecting sensor 50 at timing C2 and the paper thickness detected by the paper thickness sensor 494 during paper feeding.

In an operation (a small size and small load) of the transition states shown in FIGS. 12A to 12D, a thickness of paper fed in synchronization with printing is detected by the paper thickness sensor 494 whenever the printing is executed in a period from timing D2 when it is detected that the load thickness of paper within the paper feed tray 41 has reached the certain load thickness to timing D4 when the paper feed tray 41 is completely lifted up (empty), and a remaining paper volume calculating process is performed on the basis of the certain load thickness detected by the certain position detecting sensor 50 at timing D2 and the paper thickness detected by the paper thickness sensor 494 during paper feeding.

On the other hand, according to characteristics based on the related method (indicated by signs SP1 and SP2), for example, in the transition state operations shown in FIGS. 9A and 10D, the lift-up operation is time-consuming when the stack volume is large (a paper weight is largely changed by a paper size or quality and also these factors significantly affect the lift-up time). Even when the lift-up time is shortened by a small stack volume, variation characteristics of the lift-up time are shown to be significantly imbalanced as compared with ideal characteristics and, consequently, high detection precision cannot be expected.

In contrast, as seen from characteristics indicated by the solid line in FIG. 13, according to the remaining sheet volume detecting apparatus of this exemplary embodiment, the imbalance of the lift-up time is reduced and, consequently, a detection error of a remaining paper volume is small since the remaining paper volume is detected on the basis of a stack volume (certain load thickness) and a thickness of paper fed upon printing after an initial stack volume is reduced, regardless of whether it is an operation of a large size with a large or small volume load and an operation of a small size with a large or small volume load.

In the characteristic diagram of FIG. 13, there is shown a result of converting the certain load thickness detected by the certain position detecting sensor (near-empty sensor) 50 into the lift-up time, but a remaining volume can be separately detected without converting into the lift-up time.

Likewise, there is shown a result of converting the paper thickness detected by the paper thickness sensor 494 into the lift-up time, but a remaining volume can be separately detected without converting into the lift-up time.

Next, a process in which an accurate remaining paper volume can be calculated even when plural of types of paper pieces having different thicknesses are loaded on the paper feed tray 41 in the remaining sheet detecting apparatus of this exemplary embodiment will be verified with reference to FIGS. 14A to 14D.

FIGS. 14A to 14D are diagrams showing operation transition states related to a remaining paper volume calculating process of the paper feed tray 41 on which plural of types of paper pieces having different thicknesses are loaded, and illustrate operation transition states, for example, in which the paper feed tray 41 on which the plurality types of paper pieces whose sizes are all the A3 size and whose volume is close to the maximum load volume are loaded starts to be lifted up at timing E1 (see FIG. 14A), it is detected that a load thickness of paper within the paper feed tray 41 has reached the certain volume on the basis of a detection output of the certain position detecting sensor 50 at timing E2 while an operation is continuously performed to lift up the paper feed tray 41 to the paper feed position in synchronization with paper feeding by printing even after the paper feed tray 41 is lifted up to the paper feed position, and then the printing is executed while feeding paper and detecting a paper thickness.

Figure 14A:
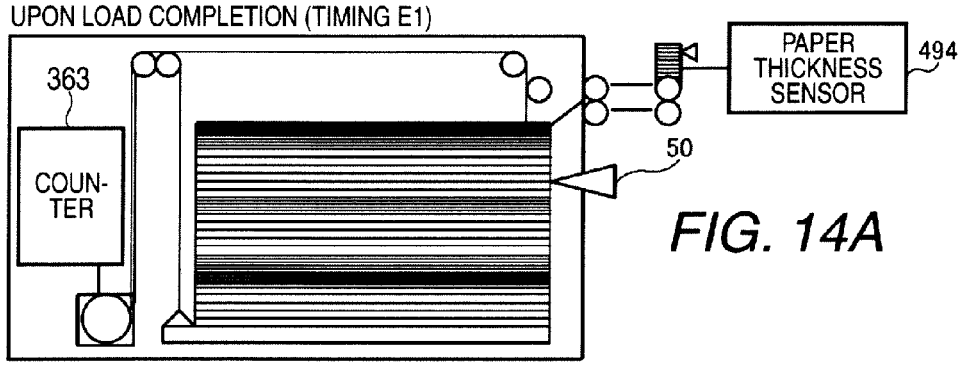
FIGS. 14A to 14D are conceptual diagrams showing operation transition states when paper pieces having different thicknesses are mixed and loaded in the exemplary embodiment 1.
Figure 14B:
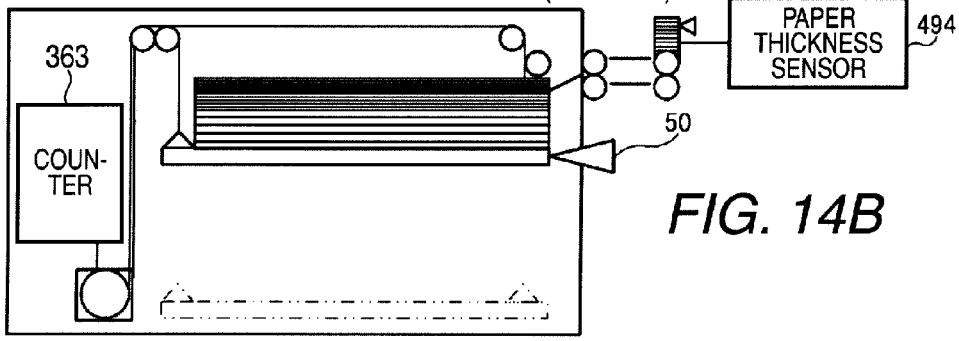
Figure 14C:
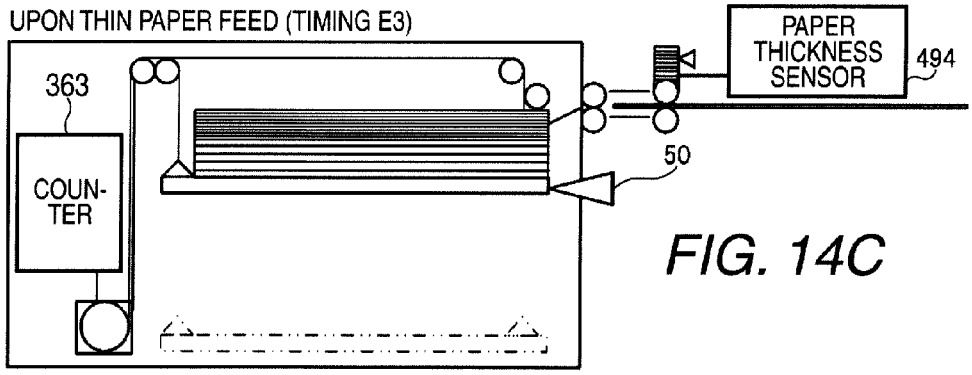
Figure 14D:
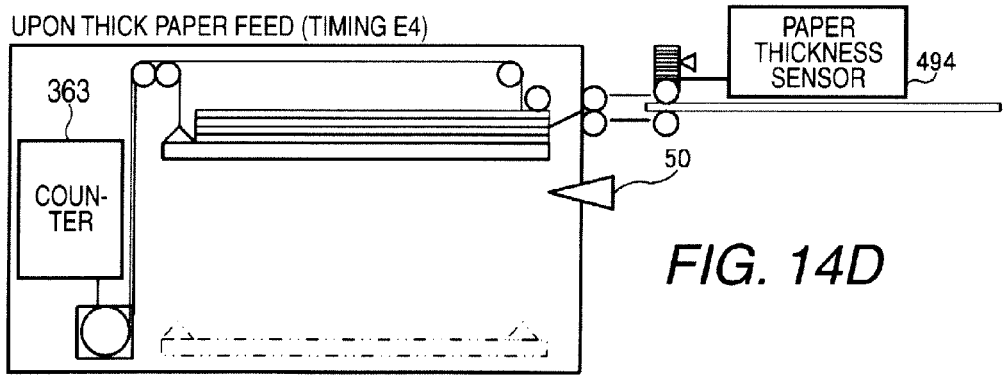

In particular, after timing E2 when the load thickness of paper within the paper feed tray 41 has reached the certain volume, the examples of FIGS. 14C and 14D illustrate operation transition states in which paper whose thickness is thin is fed and printing is executed while detecting the paper thickness at timing E3 (see FIG. 14C), and then the printing is executed by feeding paper whose thickness is thicker than that used in the previous printing at timing E4 (see FIG. 14D).

According to the operation states shown in FIGS. 14A to 14D, after timing E2, that is, after an initial stack volume of paper within the paper feed tray 41 is reduced, a remaining paper volume is detected on the basis of the stack volume (certain load thickness) and the thickness of paper fed upon printing, so that high-precision remaining volume calculation is performed by reducing a remaining paper volume by the thickness of fed paper every time even when paper pieces having different thicknesses are mixed and loaded.

Exemplary Embodiment 2

A printer (for convenience, denoted by 30B) according to an exemplary embodiment 2 has a functional block structure of the entire apparatus that is the same as the printer 30 according to the exemplary embodiment (see FIG. 1), and includes the communication I/F unit 31, the storage unit 32, the image processing unit 33, the image forming unit 34, the display/operation unit 35, and a control unit (for convenience, denoted by 36*b*).

Among them, the structures of a paper feeder (for convenience, denoted by 40B) provided in the image forming unit 34 and the control unit 36*b* are different from those of the exemplary embodiment 1.

Figure 15:
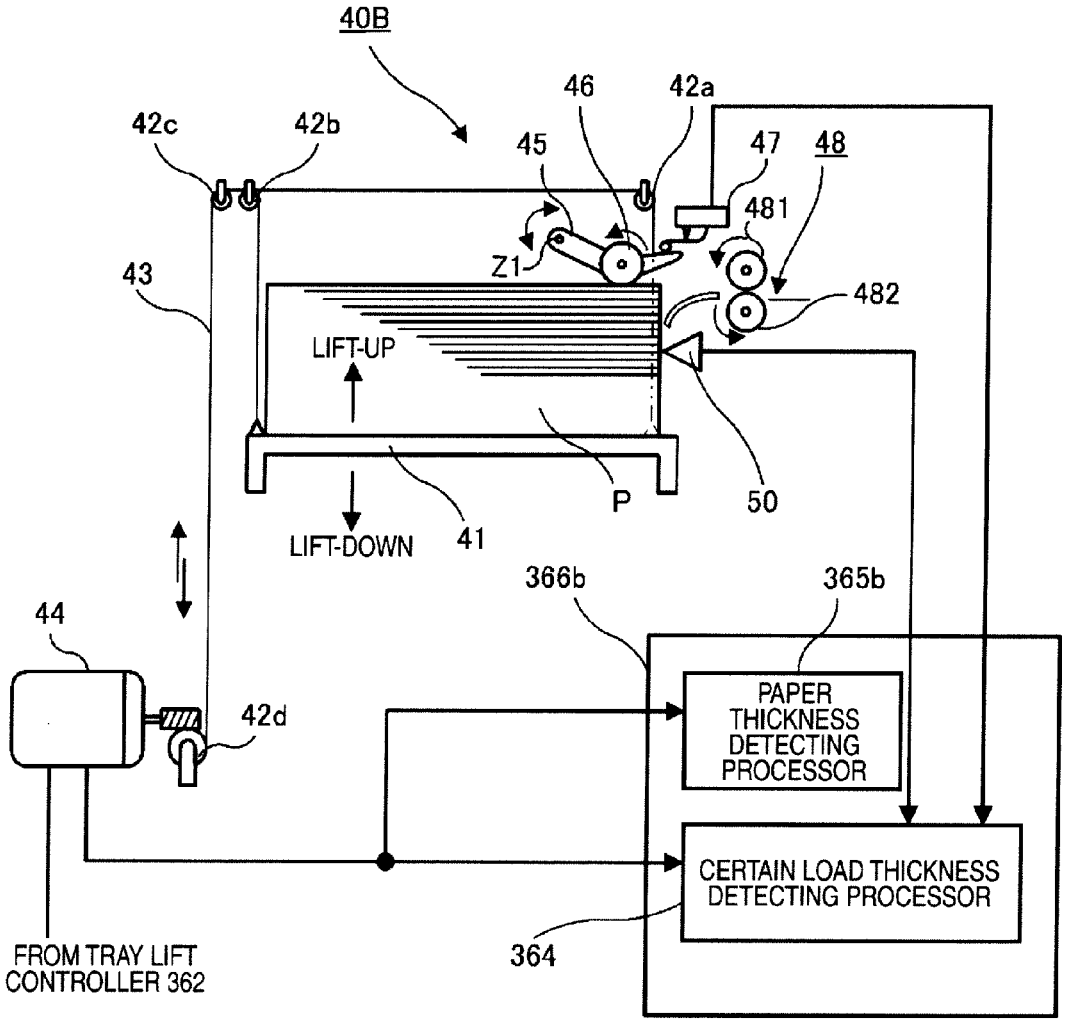
FIG. 15 is a diagram showing a schematic structure of a paper feeder of a printer according to an exemplary embodiment 2.

FIG. 15 is a diagram showing a schematic structure of the paper feeder 40B of the printer 30B according to the exemplary embodiment 2.

As shown in FIG. 15, the paper feeder 40B of the printer 30B according to this exemplary embodiment has a structure in which the paper thickness detecting roller 49 and the paper thickness sensor 494 are omitted from the structure of the paper feeder 40 of the printer 30 according to the exemplary embodiment 1 (see FIG. 2).

A structure of each of the other elements of the paper feeder 40B is the same as that within the paper feeder 40 of the printer 30 according to the exemplary embodiment 1 (the functional blocks to perform the same functions are denoted by the same reference numerals).

In FIG. 15, particularly, only the certain load thickness detecting processor 364, a paper thickness detecting processor 365*b*, and a remaining paper volume calculator 366*b* among the structures of the control unit 36*b* of the printer 30B are extracted and disclosed along with the structure of the paper feeder 40B.

The entire structure of the control unit 36*b* of the printer 30B according to this exemplary embodiment is not illustrated in the figure, but includes the paper thickness detecting processor 365*b* and the remaining paper volume calculator 366*b* having unique processing functions of this exemplary embodiment that respectively correspond to the paper thickness detecting processor 365 and the remaining paper volume calculator 366 within the control unit 36 of the printer 30 according to the exemplary embodiment 1, except for the print controller 361, the tray lift controller 362, the lift-up counter 363, the certain load thickness detecting processor 364, and the remaining paper volume reporter 367 as in the control unit 36 of the printer 30 according to the exemplary embodiment 1 when a description is given using FIG. 1.

In the above-described structure of the control unit 36*b* in the printer 30B, the certain load thickness detecting processor 364 detects that a thickness of paper loaded on the paper feed tray 41 (a load thickness) has reached the certain load thickness on the basis of a detection output of the certain position detecting sensor 50 as in the exemplary embodiment 1.

After the certain load thickness detecting processor 364 detects that a load thickness of paper within the paper feed tray 41 has reached the certain load thickness, the paper thickness detecting processor 365*b* detects a thickness of paper fed from the paper feed tray 41 upon printing according to a lift-up movement amount of the paper feed tray 41 by the drive motor 44.

Specifically, when the paper feed tray 41 is lifted up until the drive motor 44 is driven and the limit sensor 47 is turned on, if paper is fed and the limit sensor 47 is turned off, a thickness of the paper is detected on the basis of a lift-up time of the paper feed tray 41.

After the certain load thickness detecting processor 364 detects that a load thickness of paper within the paper feed tray 41 has reached the certain load thickness, the remaining paper volume calculator 366*b* performs a process to calculate a remaining volume of paper within the paper feed tray 41 on the basis of the detected certain load thickness and a thickness of paper detected by the paper thickness detecting processor 365*b* when paper is fed upon printing.

Specifically, when paper is fed upon printing after the certain load thickness detecting processor 364 detects that a load thickness of paper within the paper feed tray 41 has reached the certain load thickness, a remaining paper volume is calculated by subtracting the paper thickness detected by the paper thickness detecting processor 365*b* from the certain paper load thickness detected by the certain load thickness detecting processor 364, and then the remaining paper volume is updated by detecting a thickness of fed paper and subtracting it from a remaining paper volume calculated at the time whenever the printing is performed.

According to the printer 30B of this exemplary embodiment having the control unit 36*b* and the paper feeder 40B of the above-described structure, after the certain position detecting sensor 50 detects that a load thickness of paper within the paper feed tray 41 has reached the certain load thickness, a processing function, which detects a remaining volume of paper within the paper feed tray 41 from the detected certain load thickness and a thickness of paper fed upon printing, is the same as in the printer 30 according to the exemplary embodiment 1.

In this regard, the printer 30 according to the exemplary embodiment 1 detects a thickness of fed paper using the paper thickness sensor 494, while the printer 30B of this exemplary embodiment has a structure that detects a paper thickness from a movement amount (lift-up time) of the paper feed tray 41 by the fed paper.

According to the printer 30B of this exemplary embodiment, having the above-described structure, like the printer 30 according to the exemplary embodiment 1, a remaining paper volume calculating process operation is performed according to the flowchart shown in FIG. 7.

In this regard, when it is detected that a load thickness of paper within the paper feed tray 41 is the certain load thickness in step S107 among the processing operations shown in FIG. 7 in the printer 30B of this exemplary embodiment (step S107: YES), the transition to a remaining paper volume calculating process mode is made (step S110*b*). Here, for example, a remaining paper volume calculating process is performed as shown in FIG. 16.

Figure 16:
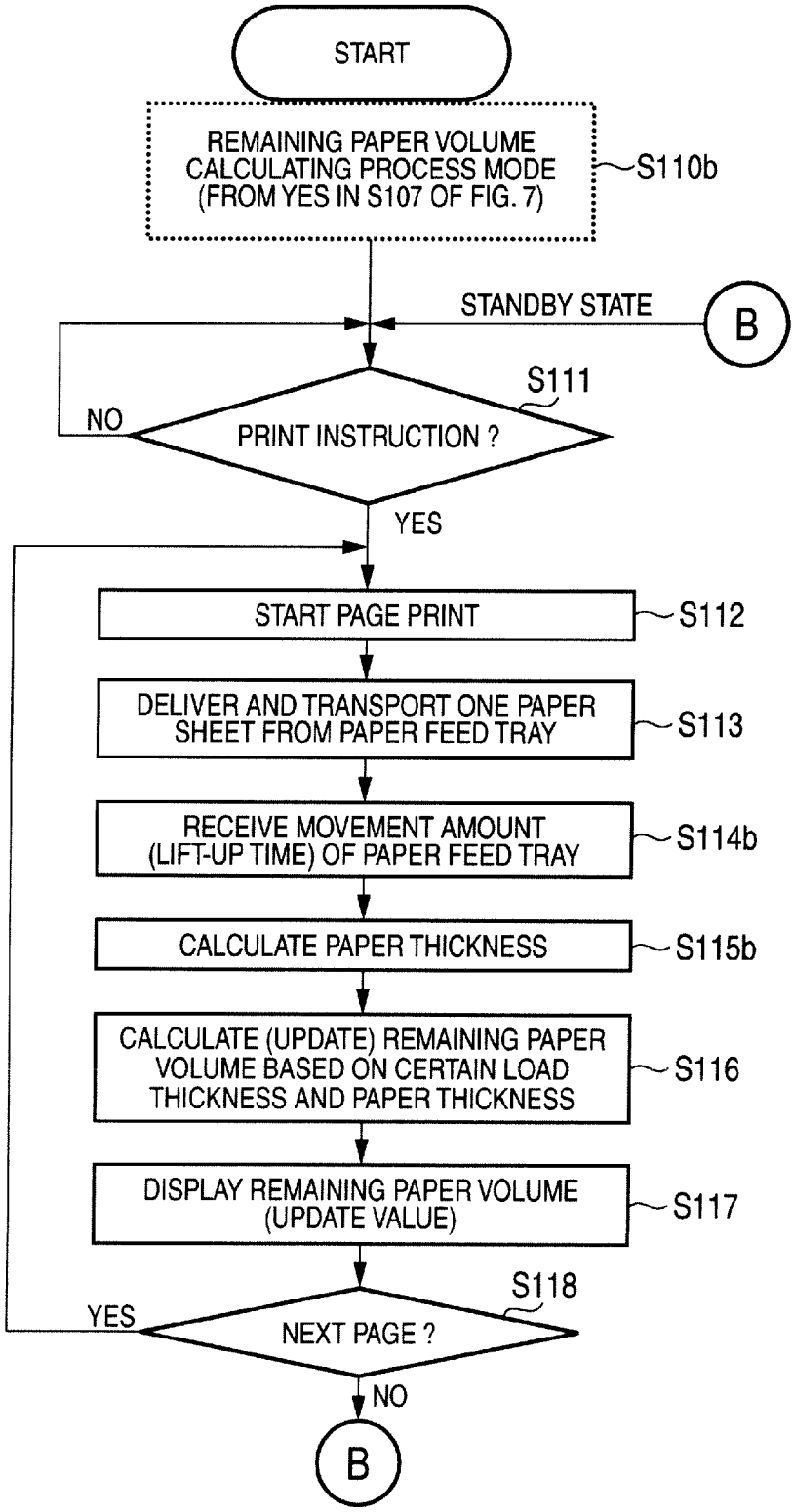
FIG. 16 is a detailed flowchart of a remaining paper volume calculating process mode of an apparatus according to the exemplary embodiment 2.

In FIG. 16, the same processing steps as those of the flowchart shown in FIG. 8 are denoted by the same reference numerals.

Here, the remaining paper volume calculating process mainly based on processes of unique steps S114*b* and S115*b* of this exemplary embodiment will be described.

As shown in FIG. 16, when the transition to the remaining paper volume calculating process mode (step S110*b*) is made, the print controller 361, for example, monitors whether or not there is a print instruction from the client terminal 10 (step S111), and causes the image processing unit 33 to generate print data by extracting image information of a first page of a print-instructed document when the print instruction exists (step S111: YES), and starts print control of the page in the image forming unit 34 on the basis of the print data (step S112).

When paper feed timing is reached in the printing of the page after the print control is started, the print controller 361 causes the delivery roller 46 to deliver one sheet of paper from the paper feed tray 41 and then causes the paper feed roller 48 to transport the paper to a transfer position (step S113).

Then, the drive motor 44 is driven, the paper feed tray 41 is lifted up by an amount corresponding to one sheet of fed paper, and a time required for the lift-up operation is counted by the lift-up counter 363.

At this time, the paper thickness detecting processor 365*b* receives a count value (lift-up time) of the lift-up counter 363 related to the lift-up operation of the paper feed tray 41 by the drive motor 44 (step S114*b*) and detects a paper thickness on the basis of the received lift-up time (the movement amount of the paper feed tray 41) (step S115*b*).

Subsequently, the remaining paper volume calculator 366*b* performs a process to calculate a remaining volume of paper currently loaded on the paper feed tray 41 on the basis of the certain load thickness detected by the certain load thickness processor 364 in step S106 of FIG. 7 and the thickness of fed paper (one sheet) detected by the paper thickness detecting processor 365*b* in step S115*b* (step S116).

Then, after a thickness of fed paper is detected to print the page through steps S112 to S115 whenever a page is printed, a process in which a remaining volume is updated by subtracting the detected thickness corresponding to one paper sheet from a remaining paper volume displayed at the time (step S116) and the updated remaining paper volume is displayed on the display unit of the display/operation unit 35 (step S117) is continued.

Next, a specific example in which high-precision remaining paper volume detection is performed by the remaining paper volume calculating process in the printer 30B of this exemplary embodiment will be verified.

Figure 17A:
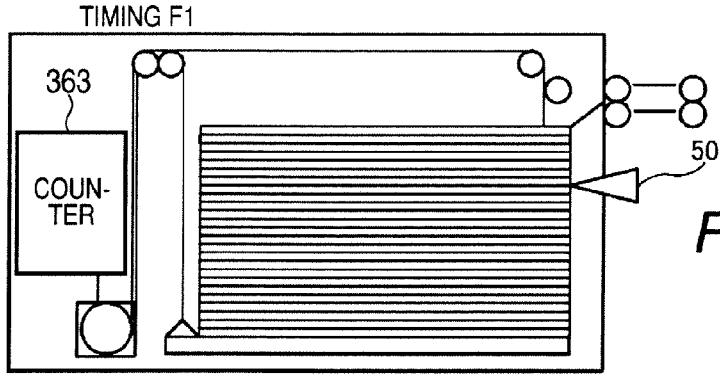
FIGS. 17A to 17D are conceptual diagrams showing operation transition states when a large volume of large size paper is loaded in the exemplary embodiment 2.
Figure 17B:
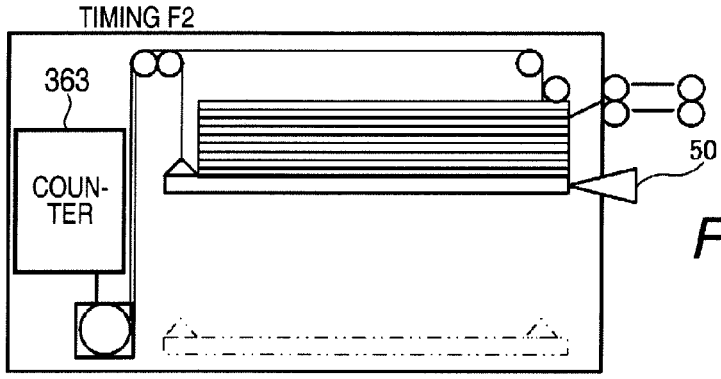
Figure 17C:
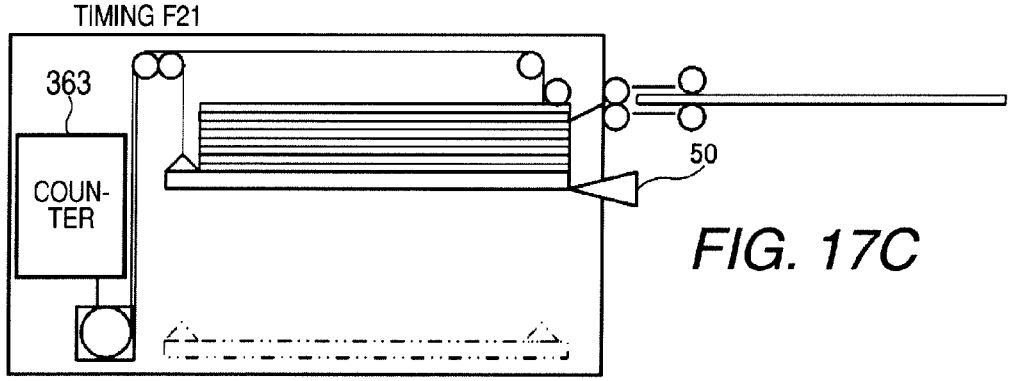
Figure 17D:
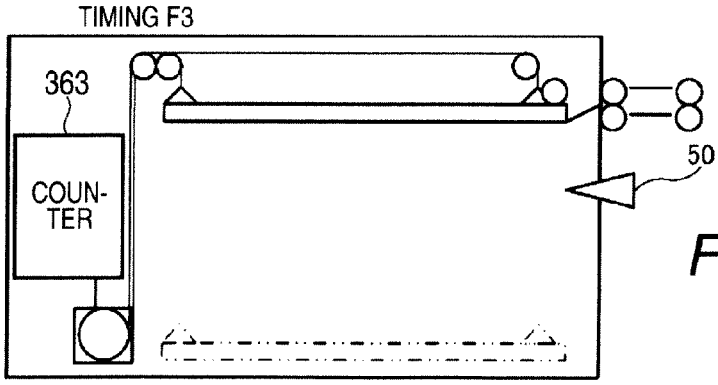

FIGS. 17A to 17D are specific examples of a remaining paper volume detecting process when a load volume is large, and illustrate operation transition states, for example, in which the paper feed tray 41 on which A3 size paper whose volume is close to the maximum load volume is loaded starts to be lifted up at timing F1 (see FIG. 17A), it is detected that a load thickness of paper within the paper feed tray 41 has reached the certain volume by referring to a detection output of the certain position detecting sensor 50 at timing F2 while an operation is continuously performed to lift up the paper feed tray 41 to the paper feed position in synchronization with paper feeding by printing even after the paper feed tray 41 is lifted up to the paper feed position (see FIG. 17B), the printing is executed while feeding paper and detecting a paper thickness from a movement amount of the paper feed tray 41 corresponding to the paper thickness after timing F3 (see FIG. 17C), and there is no paper within the paper feed tray 41 at timing F4 (see FIG. 17D).

Figure 18A:
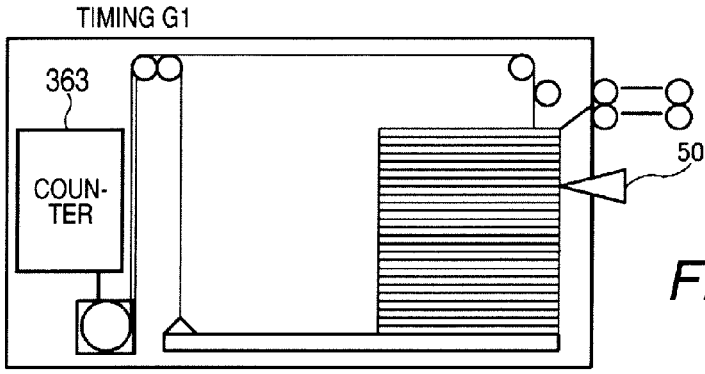
FIGS. 18A to 18D are conceptual diagrams showing operation transition states when a small volume of large size paper is loaded in the exemplary embodiment 2.
Figure 18B:
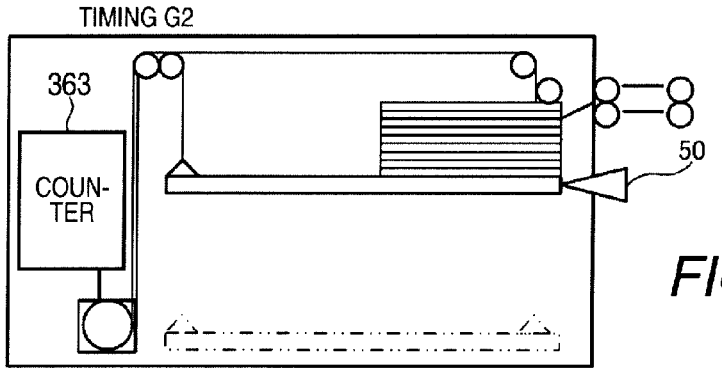
Figure 18C:
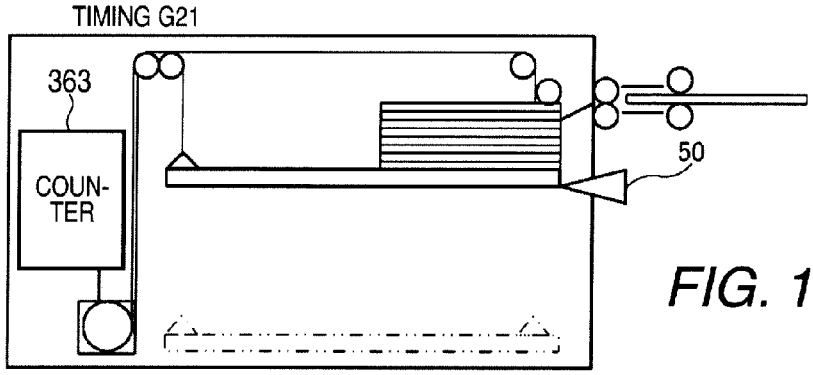
Figure 18D:
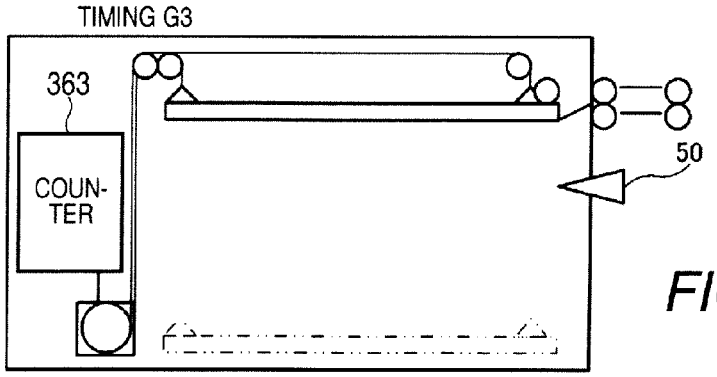

Likewise, FIGS. 18A to 18D are other specific examples of the remaining paper volume detecting process when the load volume is large, and illustrate operation transition states, for example, in which the paper feed tray 41 on which A4 size paper whose volume is close to the maximum load volume is loaded starts to be lifted up at timing G1 (see FIG. 18A), it is detected that a load thickness of paper within the paper feed tray 41 has reached the certain volume by referring to a detection output of the certain position detecting sensor 50 at timing G2 while an operation is continuously performed to lift up the paper feed tray 41 to the paper feed position in synchronization with paper feeding by printing even after the paper feed tray 41 is lifted up to the paper feed position (see FIG. 18B), the printing is executed while feeding paper and detecting a paper thickness from a movement amount of the paper feed tray 41 corresponding to the paper thickness after timing G3 (see FIG. 18C), and there is no paper within the paper feed tray 41 at timing G4 (see FIG. 18D).

Figure 19A:
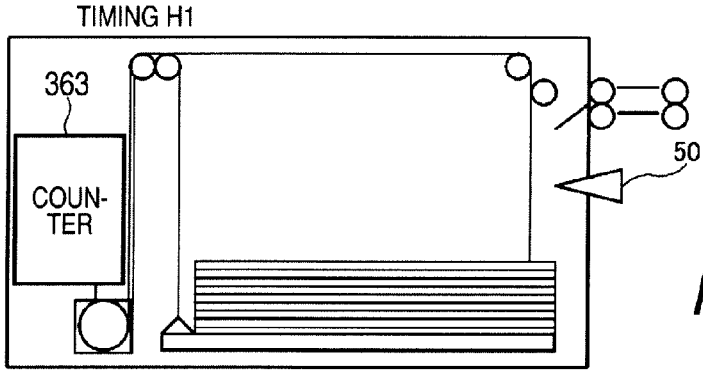
FIGS. 19A to 19D are conceptual diagrams showing operation transition states when a large volume of small size paper is loaded in the exemplary embodiment 2.
Figure 19B:
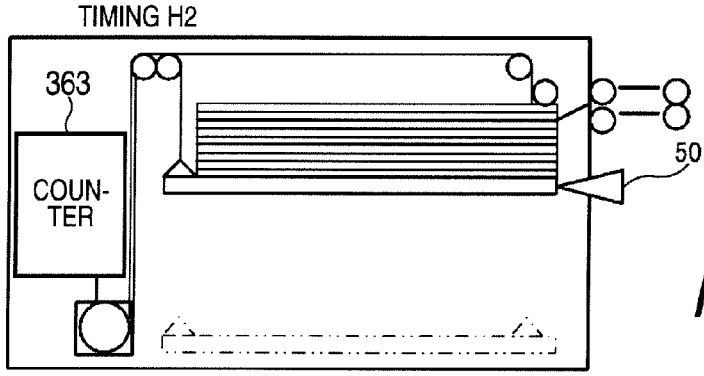
Figure 19C:
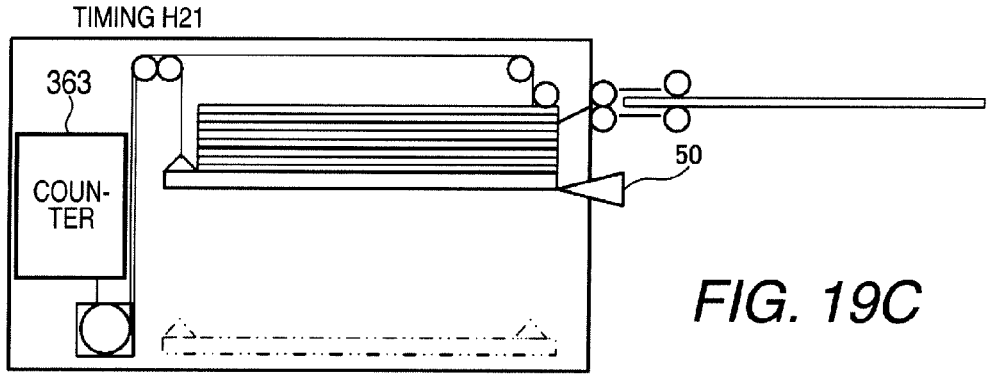
Figure 19D:
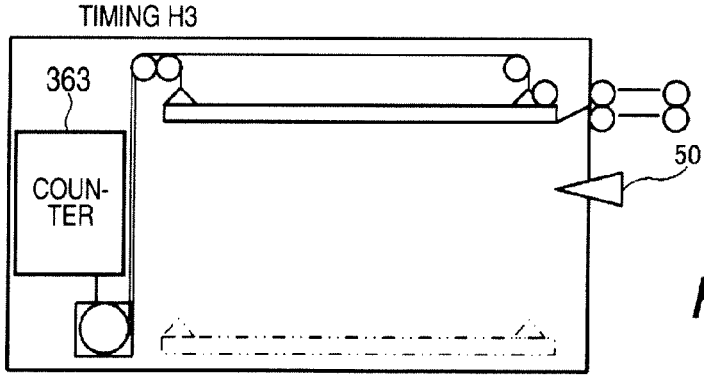

FIGS. 19A to 19D are specific examples of a remaining paper volume detecting process when a load volume is small, and illustrate operation transition states, for example, in which the paper feed tray 41 on which A3 size paper whose volume is close to near-empty is loaded starts to be lifted up at timing H1 (see FIG. 19A), it is detected that a load thickness of paper within the paper feed tray 41 has reached the certain volume by referring to a detection output of the certain position detecting sensor 50 at timing H2 while an operation is continuously performed to lift up the paper feed tray 41 to the paper feed position whenever paper is fed by printing and an output of the limit sensor 47 is turned off even after the paper feed tray 41 is lifted up to the paper feed position (see FIG. 19B), the printing is executed while feeding paper and detecting a paper thickness from a movement amount of the paper feed tray 41 corresponding to the paper thickness after timing H3 (see FIG. 19C), and there is no paper within the paper feed tray 41 at timing H4 (see FIG. 19D).

Figure 20A:
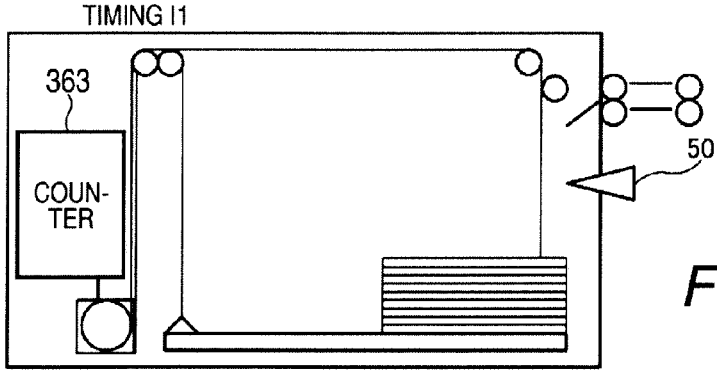
FIGS. 20A to 20D are conceptual diagrams showing operation transition states when a small volume of small size paper is loaded in the exemplary embodiment 2.
Figure 20B:
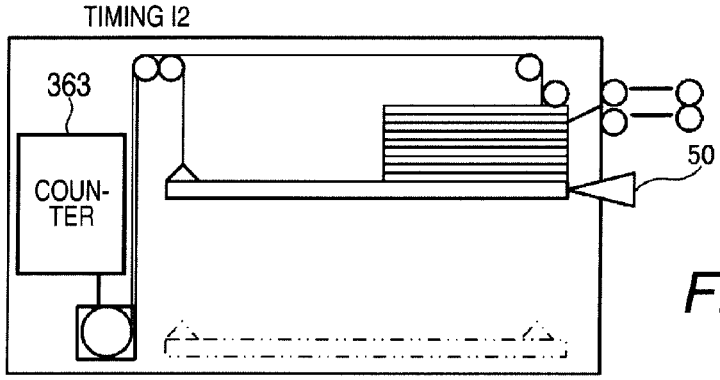
Figure 20C:
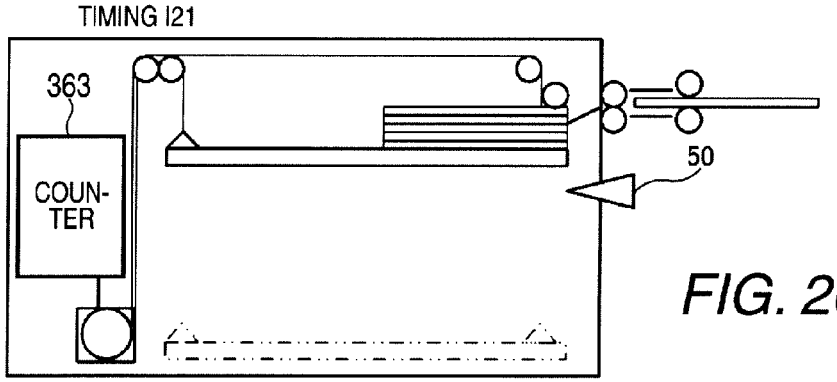
Figure 20D:
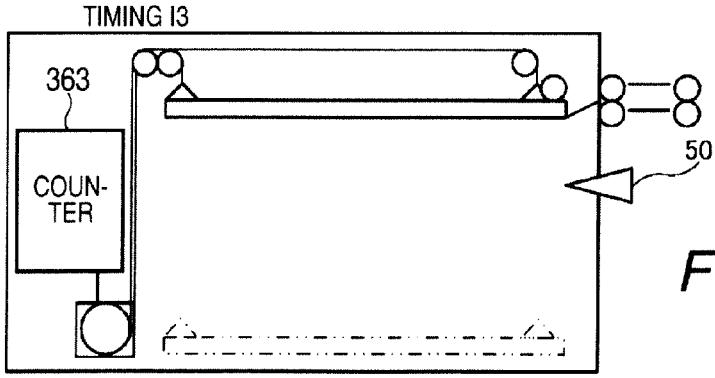

Likewise, FIGS. 20A to 20D are other specific examples of the remaining paper volume detecting process when the load volume is small, and illustrate operation transition states, for example, in which the paper feed tray 41 on which A4 size paper whose volume is close to near-empty is loaded starts to be lifted up at timing I1 (see FIG. 20A), it is detected that a load thickness of paper within the paper feed tray 41 has reached the certain volume by referring to a detection output of the certain position detecting sensor 50 at timing I2 while an operation is continuously performed to lift up the paper feed tray 41 to the paper feed position in synchronization with paper feeding by printing even after the paper feed tray 41 is lifted up to the paper feed position (see FIG. 20B), the printing is executed while feeding paper and detecting a paper thickness from a movement amount of the paper feed tray 41 corresponding to the paper thickness after timing I3 (see FIG. 20C), and there is no paper within the paper feed tray 41 at timing I4 (see FIG. 20D).

Figure 21:
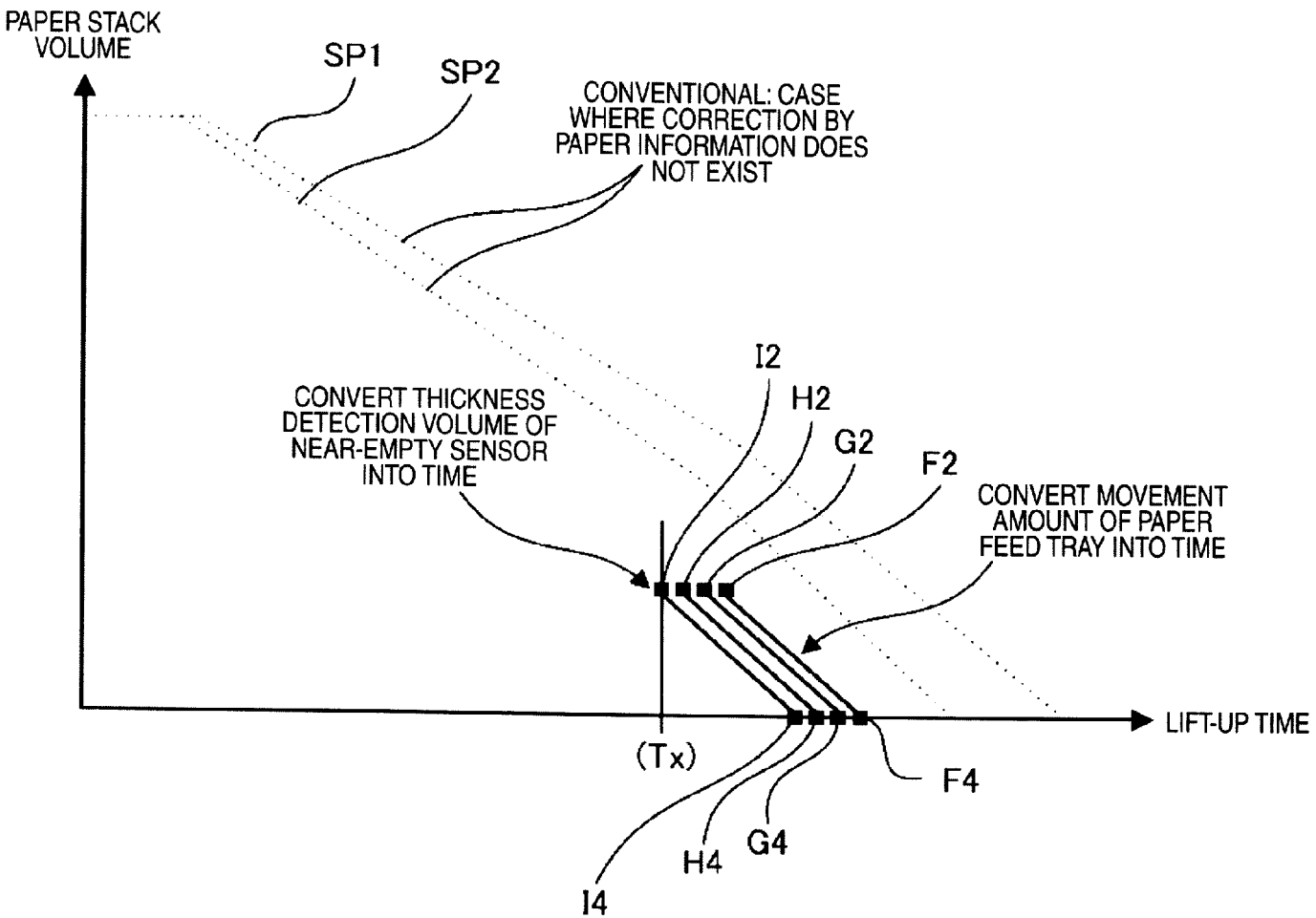
FIG. 21 is a diagram showing characteristics of a lift-up time to a paper stack volume of the apparatus according to the exemplary embodiment 2.

FIG. 21 is a diagram showing paper stack volume-lift up time characteristics of the paper feed tray 41 in the remaining sheet volume detecting apparatus mounted to the printer 30B according to this exemplary embodiment.

Signs F2, F4, G2, G4, H2, H4, I2, and I4 shown in FIG. 21 respectively correspond to timings F2, F4, G2, G4, H2, H4, I2, and I4 shown in FIGS. 17A to 20D.

In the manner of comparing with the characteristics of this exemplary embodiment, the characteristics of a lift-up time to a paper stack volume (only in the case where a paper stack volume is large) based on the related remaining sheet volume detecting method (only when correction by paper information, etc., is not performed) are indicated by the dotted line of FIG. 21.

As shown in FIG. 21, according to the remaining sheet volume detecting apparatus of this exemplary embodiment, a thickness of paper fed in synchronization with printing is detected from a movement amount (lift-up time) of the paper feed tray 41 whenever the printing is executed in a period from timing F2 when it is detected that the load thickness of paper within the paper feed tray 41 has reached the certain load thickness to timing F4 when the paper feed tray 41 is completely lifted up (empty), for example, in an operation (a large size and large load) of the transition states shown in FIGS. 17A to 17D, according to the paper stack volume-lift up time characteristics indicated by the solid line, and a remaining paper volume calculating process is performed on the basis of the certain load thickness detected by the near-empty sensor 50 at timing F2 and a paper thickness detected from the movement amount of the paper feed tray 41 during paper feeding.

In an operation (a small size and large load) of the transition states shown in FIGS. 18A to 18D, a thickness of paper fed in synchronization with printing is detected from a movement amount (lift-up time) of the paper feed tray 41 whenever the printing is executed in a period from timing G2 when it is detected that the load thickness of paper within the paper feed tray 41 has reached the certain load thickness to timing G4 when the paper feed tray 41 is completely lifted up (empty), and a remaining paper volume calculating process is performed on the basis of the certain load thickness detected by the near-empty sensor 50 at timing G2 and a paper thickness detected from the movement amount of the paper feed tray 41 during paper feeding.

In an operation (a large size and small load) of the transition states shown in FIGS. 19A to 19D, a thickness of paper fed in synchronization with printing is detected from a movement amount (lift-up time) of the paper feed tray 41 whenever the printing is executed in a period from timing H2 when it is detected that the load thickness of paper within the paper feed tray 41 has reached the certain load thickness to timing H4 when the paper feed tray 41 is completely lifted up (empty), and a remaining paper volume calculating process is performed on the basis of the certain load thickness detected by the near-empty sensor 50 at timing H2 and a paper thickness detected from the movement amount of the paper feed tray 41 during paper feeding.

In an operation (a small size and small load) of the transition states shown in FIGS. 20A to 20D, a thickness of paper fed in synchronization with printing is detected from a movement amount (lift-up time) of the paper feed tray 41 whenever the printing is executed in a period from timing I2 when it is detected that the load thickness of paper within the paper feed tray 41 has reached the certain load thickness to timing I4 when the paper feed tray 41 is completely lifted up (empty), and a remaining paper volume calculating process is performed on the basis of the certain load thickness detected by the near-empty sensor 50 at timing I2 and a paper thickness detected from the movement amount of the paper feed tray 41 during paper feeding.

On the other hand, according to characteristics based on the related method (indicated by signs SP1 and SP2), for example, in the transition state operations shown in FIGS. 17 and 18, the lift-up operation is time-consuming when the stack volume is large (a paper weight is largely changed by a paper size or quality and also these factors significantly affect the lift-up time). Even when the lift-up time is shortened by a small stack volume, variation characteristics of the lift-up time are shown to be significantly imbalanced as compared with ideal characteristics and, consequently, high detection precision cannot be expected.

In contrast, as seen from characteristics indicated by the solid line in FIG. 21, according to the remaining sheet volume detecting apparatus of this exemplary embodiment, the imbalance of the lift-up time is small and, consequently, a detection error of a remaining paper volume is reduced since the remaining paper volume is detected on the basis of a stack volume (certain load thickness) and a thickness of paper fed upon printing [detected on the basis of a movement amount (lift-up time) of the paper feed tray 41] after an initial stack volume is reduced, regardless of whether it is an operation of a large size with a large or small volume load and an operation of a small size with a large or small volume load.

In the characteristic diagram of FIG. 21, there is shown a result of converting the certain load thickness detected by the certain position detecting sensor (near-empty sensor) 50 into the lift-up time, but a remaining volume can be separately detected without converting into the lift-up time.

Likewise, there is shown a result of converting a paper thickness detected by the movement amount of the paper feed tray 41 into the lift-up time, but a remaining volume can be separately detected without converting into the lift-up time.

Next, a process in which an accurate remaining paper volume can be calculated even when plural of types of paper pieces having different thicknesses are loaded on the paper feed tray 41 in the remaining sheet detecting apparatus of this exemplary embodiment will be verified with reference to FIGS. 22A to 22D.

FIGS. 22A to 22D are diagrams showing operation transition states related to a remaining paper volume calculating process of the paper feed tray 41 on which plural of types of paper pieces having different thicknesses are loaded and, for example, illustrates an operation transition state when the paper feed tray 41 on which the plurality types of paper pieces whose sizes are all the A3 size and whose volume is close to a maximum load volume are loaded starts to be lifted up at timing J1 (see FIG. 22A), it is detected that a load thickness of paper within the paper feed tray 41 has reached the certain volume on the basis of a detection output of the certain position detecting sensor 50 at timing J2 while an operation is continuously performed to lift up the paper feed tray 41 to the paper feed position in synchronization with paper feeding by printing even after the paper feed tray 41 is lifted up to the paper feed position, and then the printing is executed while feeding paper and detecting a thickness of the paper.

Figure 22A:
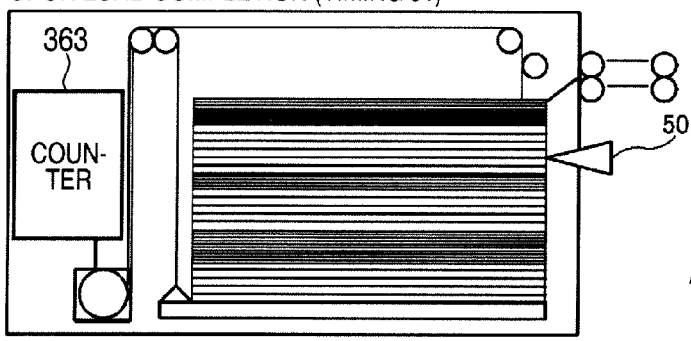
FIGS. 22A to 22D are conceptual diagrams showing operation transition states when paper pieces of different thicknesses are mixed and loaded in the exemplary embodiment 2.
Figure 22B:
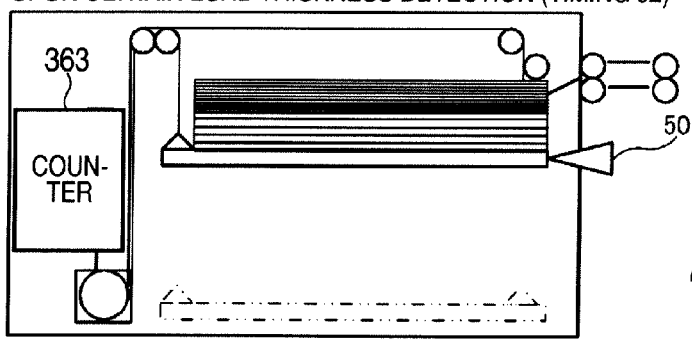
Figure 22C:
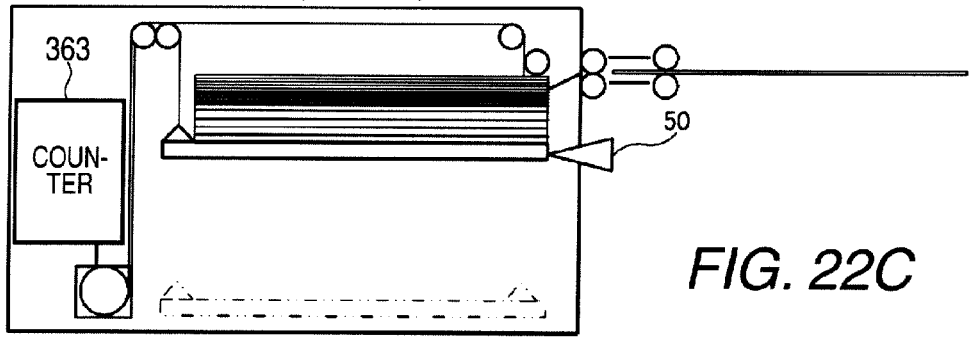
Figure 22D:
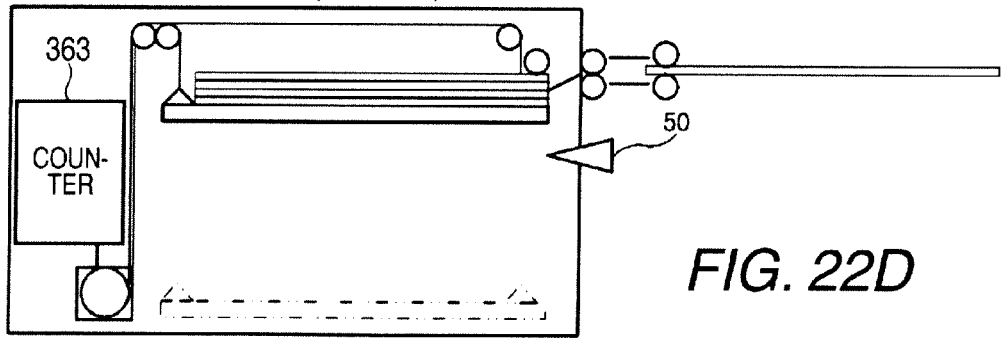

In particular, after timing J2 when the load thickness of paper within the paper feed tray 41 has reached the certain volume, the examples of FIGS. 22C and 22D illustrate operation transition states in which thin paper is fed and the printing is executed while detecting the paper thickness at timing J3 (see FIG. 22C), and then the printing is executed by feeding paper whose thickness is thicker than that used in the previous printing at timing J4 (see FIG. 22D).

According to the operation states shown in FIGS. 22A to 22D, after timing J2, that is, after an initial stack volume of paper within the paper feed tray 41 is reduced, a remaining paper volume is detected on the basis of the stack volume (certain load thickness) and a thickness of paper fed upon printing [detected on the basis of a movement amount (lift-up time) of the paper feed tray 41], so that high-precision remaining volume calculation is performed by reducing a remaining paper volume by a thickness of fed paper every time even when paper pieces having different thicknesses are mixed and loaded.

Exemplary Embodiment 3

A printer (for convenience, denoted by 30C) according to an exemplary embodiment 3 has a functional block structure of the entire apparatus that is the same as the printer 30 according to the exemplary embodiment (see FIG. 1), and includes the communication I/F unit 31, the storage unit 32, the image processing unit 33, and the image forming unit 34, the display/operation unit 35, and a control unit (for convenience, denoted by 36*c*).

Among them, the structures of a paper feeder (for convenience, denoted by 40C) provided in the image forming unit 34 and the control unit 36*c* are different from those of the exemplary embodiment 1.

Figure 23:
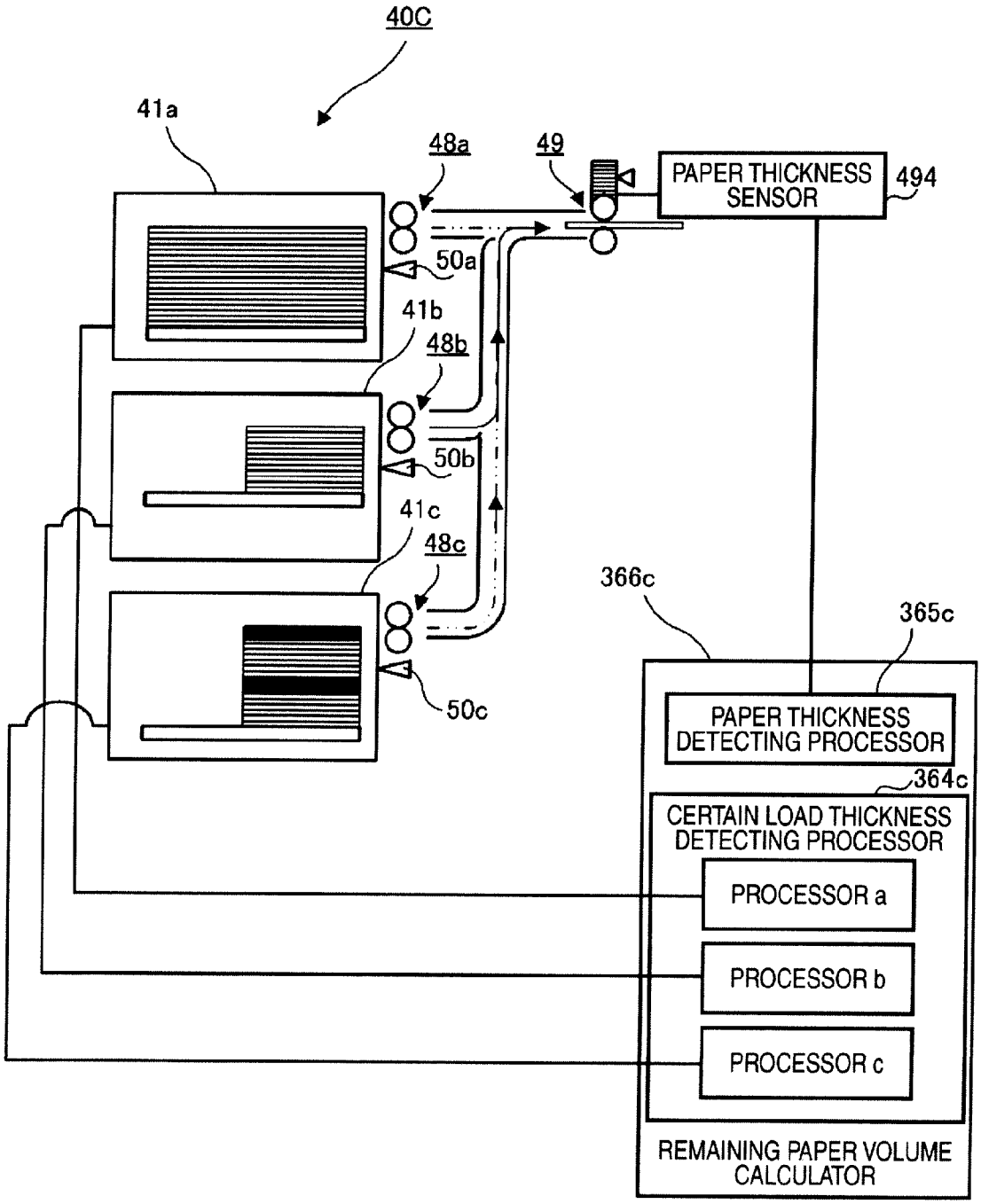
FIG. 23 is a diagram showing a schematic structure of a paper feeder of a printer according to an exemplary embodiment 3.

FIG. 23 is a conceptual diagram showing a structure of the paper feeder 40C of the printer 30C according to the exemplary embodiment 3.

As shown in FIG. 23, the paper feeder 40C of the printer 30C has plural of paper feed trays 41*a*, 41*b*, and 41*c*.

For example, in the paper feed trays 41*a*, 41*b*, and 41*c*, a tray lift drive mechanism including the pulleys 42*a*, 42*b*, 42*c*, and 42*d*, the wire 43, the drive motor 44, a cam 45, the delivery roller 46, and the limit sensor 47 like the tray lift drive mechanism of the paper feed tray 41 according to the exemplary embodiment 1 (see FIG. 2) is individually provided, and also paper feed rollers 48*a*, 48*b*, and 48*c*, which transport paper delivered from the delivery roller 46 of the paper feed trays 41*a*, 41*b*, and 41*c*, and position detecting sensors 50*a*, 50*b*, and 50*c*, which detect that a load thickness of paper of the paper feed trays 41*a*, 41*b*, and 41*c* has reached the certain load thickness, are especially provided.

On the other hand, at a downstream side of a paper transport direction of the paper feed rollers 48*a*, 48*b*, and 48*c* of the paper feed trays 41*a*, 41*b*, and 41*c*, one paper thickness detecting roller 49 shared by the paper feed trays 41*a*, 41*b*, and 41*c* is provided.

This paper thickness detecting roller 49 is the same as that of the exemplary embodiment 1, and has the paper thickness sensor 494 (see FIG. 3).

The paper feeder 40C of the printer 30C has a paper transport path structure in which paper feed transport paths of the paper feed trays 41*a*, 41*b*, and 41*c* are joined together in the middle, and the paper thickness detecting roller 49 and the paper thickness sensor 494 are provided in a paper-feed transport path after the join and used to detect a thickness of paper fed from the paper feed trays 41*a*, 41*b*, and 42*c* upon print.

In FIG. 23, in the structure of the control unit 36*c* of the printer 30C along with the structure of the paper feeder 40C, particularly, only the certain load thickness detecting processor 364*c*, a paper thickness detecting processor 365*c*, and a remaining paper volume calculator 366*c* are extracted and disclosed.

The entire structure of the control unit 36*c* of the printer 30C according to this exemplary embodiment is not shown in the figure, but includes a print controller 361*c*, a tray lift controller 362*c*, a lift-up counter 363*c*, the certain load thickness detecting processor 364*c*, the paper thickness detecting controller 365*c*, the remaining paper volume calculator 366*c*, and a remaining paper volume reporter 367*c*, having unique processing functions of this exemplary embodiment, that respectively correspond to the print controller 361, the tray lift controller 362, the lift-up counter 363, the certain load thickness detecting processor 364, the paper thickness detecting controller 365, the remaining paper volume calculator 366, and the remaining paper volume reporter 367 in the control unit 36 of the printer 30 according to the exemplary embodiment 1 when a description is given using FIG. 1.

For example, on the basis of a print instruction from the client terminal 10, the print controller 361*c* performs a control operation to print a print instruction document by selectively feeding paper from a paper feed tray designated by the print instruction (or a certain paper feed tray accommodating a type of paper designated by the print instruction) among the plurality of paper feed trays 41*a*, 41*b*, and 41*c*.

The tray lift controller 362*c* controls a corresponding paper feed tray to be lifted up by selectively driving tray lift drive mechanisms provided in correspondence with the paper feed trays 41*a*, 41*b*, and 41*c*.

The lift-up counter 363*c* includes, for example, a counter provided in correspondence with each of the paper feed trays 41*a*, 41*b*, and 41*c*. Each counter counts a lift-up time of a corresponding paper feed tray.

The certain load thickness detecting processor 364*c* has processors (processors a, b, and c in FIG. 23), which correspond to the paper feed trays 41*a*, 41*b*, and 41*c* and detect a load thickness of paper loaded on the paper feed trays 41*a*, 41*b*, and 41*c* from detection outputs of the certain position detecting sensors 50*a*, 50*b*, and 50*c* provided in correspondence with the paper feed trays 41*a*, 41*b*, and 41*c*.

The paper thickness detecting processor 365*c* detects a thickness of paper fed from each paper feed tray 41*a*, 41*b*, or 41*c* upon printing by identifying a paper feed tray of a paper feed source of the paper.

The remaining paper volume calculator 366*c* calculates a remaining volume of sheets loaded on each paper feed tray 41*a*, 41*b*, or 41*c* on the basis of the thickness of fed paper detected by identifying each paper feed tray 41*a*, 41*b*, or 41*c* of the paper feed source by the paper thickness detecting processor 365*c* and a total sheet load thickness detected by the certain load thickness detecting processor 364*c* in correspondence with each paper feed tray 41*a*, 41*b*, or 41*c*.

The remaining paper volume reporter 367*c* performs a process of reporting a remaining paper volume of each paper feed tray 41*a*, 41*b*, or 41*c* calculated by the remaining paper volume calculator 366*c* in correspondence with each paper feed tray 41*a*, 41*b*, or 41*c*.

Figure 24:
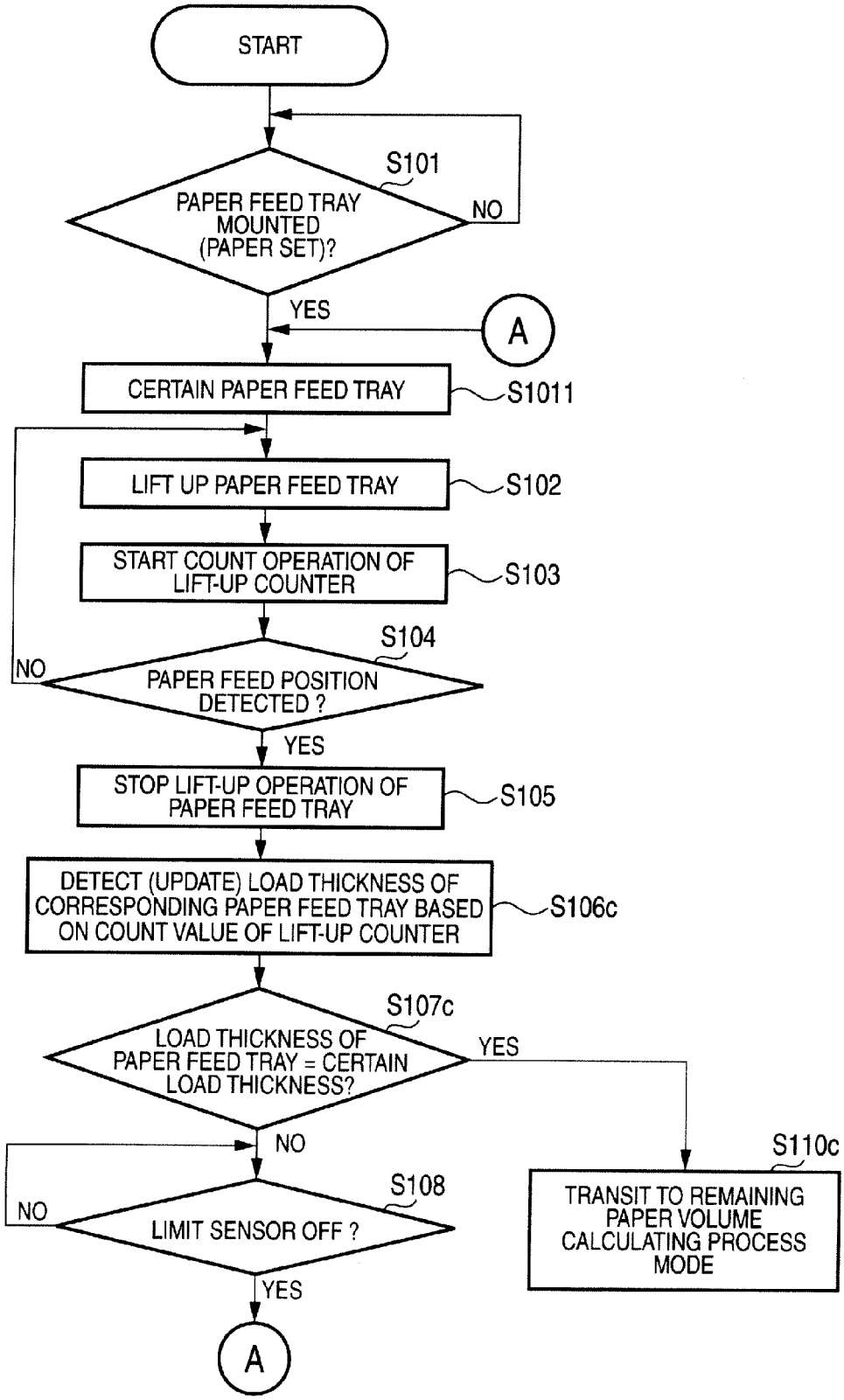
FIG. 24 is a flowchart showing a remaining paper volume calculating process operation of an apparatus according to the exemplary embodiment 3.

FIG. 24 is a flowchart showing a remaining paper volume calculating process operation of the printer 30C according to this exemplary embodiment.

In FIG. 24, the same processing steps as those of the exemplary embodiment 1 shown in FIG. 7 are denoted by the same step numerals (a sign "c" is additionally attached to unique processing steps of this exemplary embodiment).

As shown in FIG. 24, when the mounting of the paper feed tray 41 (one of 41*a*, 41*b*, and 41*c*) filled with paper is detected in the printer 30C of this exemplary embodiment (step S101: YES), the tray lift controller 362*c* specifies the mounted paper feed tray, for example, 41*a* (or 41*b* or 41*c*), (step S1011), starts the tray lift drive mechanism corresponding to the certain paper feed tray 41*a* (or 41*b* or 41*c*) to lift up the paper feed tray 41*a* (or 41*b* or 41*c*) (step S102), and starts the lift-up counter 363*c* to count a lift-up time corresponding to the paper feed tray 41*a* (or 41*b* or 41*c*) (step S103).

Then, while the paper feed tray 41*a* (or 41*b* or 41*c*) does not reach the paper feed position (step S104: NO), the lift-up operation of the paper feed tray 41*a* (or 41*b* or 41*c*) and the counting operation of the lift-up time are continued (steps S102 and S103). When the paper feed tray 41*a* (or 41*b* or 41*c*) has reached the paper feed position (step S104: YES), the lift-up operation of the paper feed tray 41*a* (or 41*b* or 41*c*) is stopped and the certain load thickness detecting processor 364*c* [the processor a corresponding to the paper feed tray 41*a* (or the processor b corresponding to the paper feed tray 41*b* or the processor c corresponding to the paper feed tray 41*c*)] reads the count value corresponding to the paper feed tray 41*a* of the lift-up counter 363*c* when the counting operation is stopped in step S105, and detects a load thickness of paper within the paper feed tray 41*a* (or 41*b* or 41*c*) using the above-described Expression (2), on the basis of the lift-up time (step S106*c*).

Subsequently, the certain load thickness detecting processor 364*c* [the processor a corresponding to the paper feed tray 41*a* (or the processor b corresponding to the paper feed tray 41*b* or the processor c corresponding to the paper feed tray 41*c*)] checks whether the paper load thickness of the paper feed tray 41*a* (or 41*b* or 41*c*) detected in step S106*c* is the certain load thickness (step S107*c*). When it is not the certain load thickness (step S107*c*: NO), the tray lift controller 362*c* checks whether or not an output of one of the limit sensors 47 respectively corresponding to the paper feed trays 41*a*, 41*b*, and 41*c* is "OFF" (step S108).

Here, when the limit sensor 47 corresponding to the paper feed tray 41*a* (or 41*b* or 41*c*) is turned off, for example, by feeding paper from the paper feed tray 41*a* (or 41*b* or 41*c*) upon printing (step S108: YES), the tray lift controller 362*c* specifies the paper feed tray 41*a* (or 41*b* or 41*c*) of which the limit sensor 47 is turned off (step S1011) and drives the tray lift drive mechanism corresponding to the certain paper feed tray 41*a* (or 41*b* or 41*c*) to lift up the paper feed tray 41*a* (or 41*b* or 41*c*) until the paper feed position is reached (steps S102 to S105). On the other hand, the certain load thickness detecting processor 364*c* [the processor a corresponding to the paper feed tray 41*a* (or the processor b corresponding to the paper feed tray 41*b* or the processor c corresponding to the paper feed tray 41*c*)] updates a load thickness of paper within the paper feed tray 41*a* (or 41*b* or 41*c*) on the basis of the lift-up time corresponding to the paper feed tray 41*a* (or 41*b* or 41*c*) during this period (step S106*c*).

Thereafter, while the updated load thickness of each paper feed tray 41*a*, 41*b*, or 41*c* in step S106*c* does not reach the certain load thickness (step S107*c*: NO) as described above, the process of steps S102 to S106*c* is continued whenever the output of the corresponding limit sensor 47 is "OFF" (step S108: YES).

During this period, when the certain load thickness detecting processor 364*c* [the processor a corresponding to the paper feed tray 41*a* (or the processor b corresponding to the paper feed tray 41*b* or the processor c corresponding to the paper feed tray 41*c*)] determines that the load thickness of paper within the corresponding paper feed tray 41*a* (or 41*b* or 41*c*) is the certain load thickness by obtaining a detection output of the certain position detecting sensor 50*a* (or 50*b* or 50*c*) (step S107*c*: YES), the corresponding paper feed tray 41*a* (or 41*b* or 41*c*) enters the remaining paper volume calculating process mode (step S110*c*).

Figure 25:
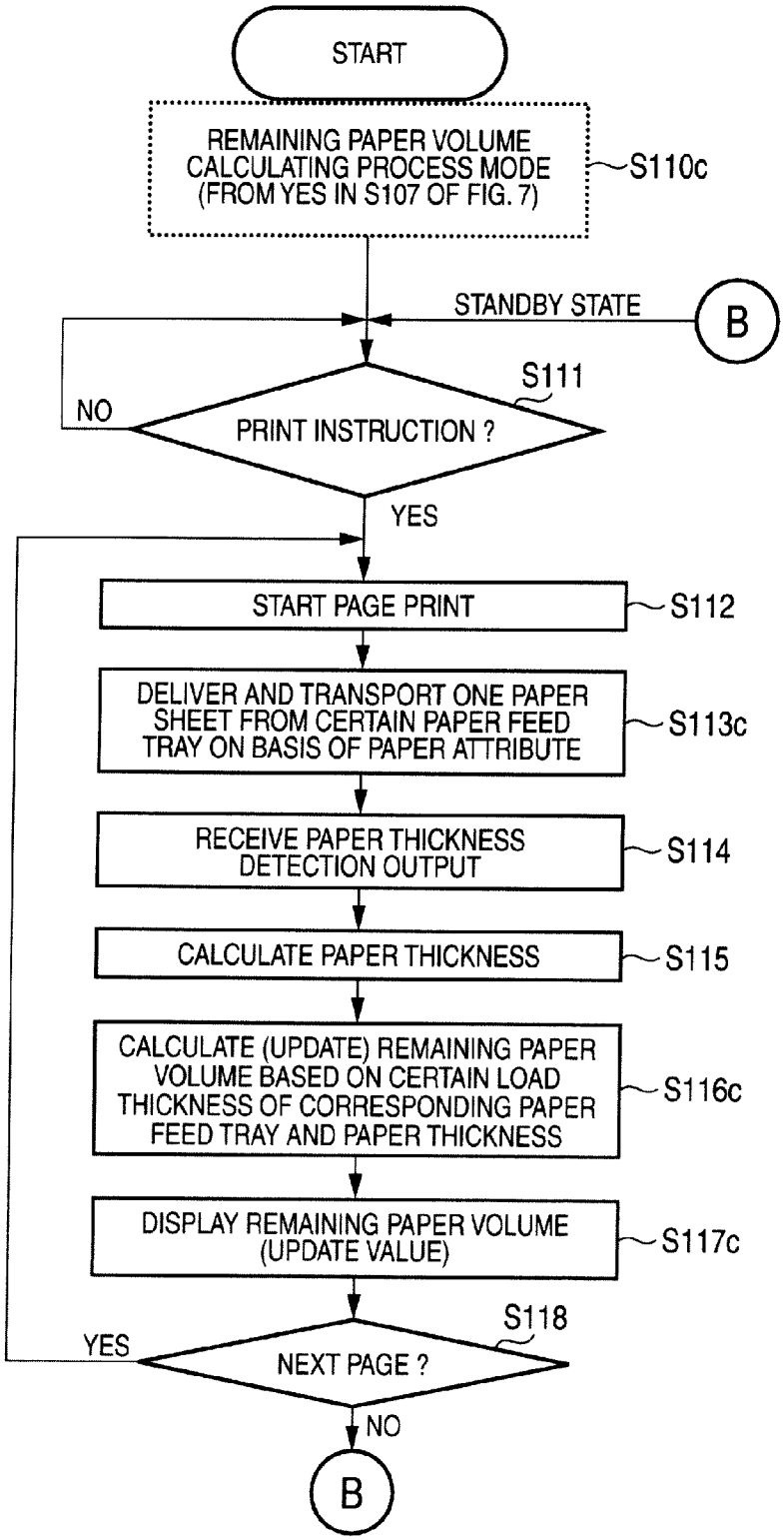
FIG. 25 is a detailed flowchart of a remaining paper volume calculating process mode of the apparatus according to the exemplary embodiment 3.

FIG. 25 is a flowchart showing a detailed processing operation of the remaining paper volume calculating process mode according to this exemplary embodiment.

As shown in FIG. 25, in the remaining paper volume calculating process mode (step S110*c*), the print controller 361*c*, for example, monitors whether or not there is a print instruction from the client terminal 10 (step S111). When the print instruction exists (step S111: YES), the printer controller 361*c* causes the image processing unit 33 to generate print data by extracting image information of a first page of a print-instructed document, and starts print control of the page at the image forming unit 34 on the basis of the print data (step S112).

Then, a paper attribute (paper size or type) is detected from print instruction content and paper having the paper attribute is loaded. For example, the paper feed tray 41*a* (or 41*b* or 41*c*) is certain and one sheet of paper is delivered and transported from the paper feed tray 41*a* (or 41*b* or 41*c*) in synchronization with paper feed timing (step S113*c*).

During the paper transportation, the paper thickness detecting processor 365*c* receives a detection output of the paper thickness sensor 494 when fed paper passes through between facing rollers of the paper thickness detecting roller 49 (step S114) and a thickness of paper being transported is detected from the detection output (step S115).

Subsequently, the remaining paper volume calculator 366*c* calculates a remaining volume of paper loaded on the paper feed tray 41*a* (or 41*b* or 41*c*) of the corresponding paper feed source on the basis of the certain load thickness, detected by the certain load thickness detecting processor 364*c* corresponding to the paper feed tray 41*a* (or 41*b* or 41*c*) of the corresponding paper feed source [the processor a corresponding to the paper feed tray 41*a* (or the processor b corresponding to the paper feed tray 41*b* or the processor c corresponding to the paper feed tray 41*c*)] in step S106 on the basis of a specific result that the paper feed tray 41*a* (or 41*b* or 41*c* is the paper feed source, and a thickness of one paper sheet from the paper feed source of the paper feed tray 41*a* (or 41*b* or 41*c*) detected by the paper thickness detecting processor 365*c* (step S116*c*).

The remaining paper volume reporter 367*c* displays a remaining paper volume of the paper feed tray 41*a* (or 41*b* or 41*c*) calculated in step S116*c* on the display unit of the display/operation unit 35 corresponding to the paper feed tray 41*a* (or 41*b* or 41*c*) (step S117*c*).

Thereafter, when a thickness of paper fed to print a corresponding page is detected in the same way after a first sheet starts to be printed while it is determined that the next page exists (step S118: YES), a corresponding remaining paper volume is updated by subtracting the remaining volume corresponding to the thickness of one sheet from a remaining paper volume of the paper feed tray 41*a* (or 41*b* or 41*c*) of the paper feed source displayed at the time (steps S112 to S116*c*) and the updated remaining paper volume is displayed on the display unit (step S117*c*). When it is determined that the next page does not exist (step S118: NO), the process is terminated and the transition to the standby state is made.

It is monitored whether or not the print instruction exists even in the standby state. Whenever the print instruction exists (step S111: YES), a process is executed to detect a thickness of paper fed upon print, update a corresponding remaining paper volume by subtracting the detected thickness corresponding to one sheet of paper fed upon printing from a remaining paper volume in the paper feed tray 41*a* (or 41*b* or 41*c*) of the paper feed source at the time, and display the updated remaining paper volume in correspondence with the paper feed tray 41*a* (or 41*b* or 41*c*) of the paper feed source (steps S112 to S117*c*).

In this exemplary embodiment described above, in the structure of the remaining sheet volume detecting apparatus in which the plurality of paper feed trays 41*a*, 41*b*, and 41*c* are provided, it is detected that a load thickness of paper within each paper feed tray 41*a*, 41*b*, or 41*c* has reached the certain load thickness on the basis of a detection output of each corresponding certain position detecting sensor 50, and then a remaining volume of paper within each corresponding paper feed tray 41*a*, 41*b*, or 41*c* is calculated on the basis of the detected certain load thickness and a thickness of paper fed upon printing for each corresponding paper feed tray 41*a*, 41*b*, or 41*c*, one paper thickness detecting unit (the paper thickness sensor 494) is used to detect the thickness of paper fed from each paper feed tray 41*a*, 41*b*, or 41*c*.

According to the exemplary embodiment shown in FIGS. 23 to 25, when the remaining paper volume is calculated on the basis of the detected certain load thickness and the thickness of paper fed upon printing for each corresponding paper feed tray 41*a*, 41*b*, or 41*c*, a structure to detect the paper thickness using the paper thickness sensor 494 (by applying the paper thickness detecting method of the exemplary embodiment 1) has been illustrated, but a structure may be made to detect the paper thickness from a movement amount of each paper feed tray 41*a*, 41*b*, or 41*c* when paper is fed upon printing, as in the exemplary embodiment 2, in place of the paper thickness sensor 494.

In addition, the present invention is not limited to the above-described exemplary embodiments shown in the drawings, and appropriate modifications can be made within the scope without changing the subject matter thereof.

For example, in the exemplary embodiments 1 and 3, the dedicated paper thickness sensor 494 is provided as a mechanism to detect a thickness of paper to be fed. Alternatively, when overlap feed detecting unit is provided to detect the paper thickness by the thickness detecting sensor upon paper feeding and detect overlap feed in which plural of paper pieces are overlapped and transported on the basis of the detected paper thickness, the thickness detecting sensor constituting the overlap feed detecting unit may be configured to be used as the paper thickness sensor 494.

In each exemplary embodiment described above, a structure in which the limit sensor 47 is used to detect that the paper feed tray 41 has been lifted up to the paper feed position has been illustrated, but it is not limited thereto. For example, various detecting mechanisms may be adopted to detect a lift-up time (an operation time of the drive motor) by recognizing that set paper is in contact with the delivery roller and the rotation of the drive roller is stopped.

In each exemplary embodiment described above, a printer that processes a print job from the client terminal 10 has been illustrated, but the present invention is applicable to a general image forming apparatus having a mechanism to feed loaded paper in a state in which the paper feed tray is lifted up to the paper feed position, such as a compound device that executes printing on the basis of a print instruction (print start instruction or copy start instruction) from a local terminal.

The present invention can be applied to an apparatus that detects a remaining volume of sheets loaded on sheet loading unit, and, in particular, is suitable for an apparatus that detects a remaining volume of paper within a paper feed tray in an image forming apparatus having the paper feed tray on which recoding paper as a sheet is loaded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A remaining sheet volume detecting apparatus, comprising:

a first loading unit that loads sheets;

a first moving unit that moves the first loading unit to a feeding position of one of the loaded sheets;

a first feeding unit that feeds the one of the loaded sheets from a top position of the first loading unit which has reached the feed position;

a lift-up motor to elevate and lower the first loading unit;

a sheet thickness detecting unit that detects a thickness of the one of the sheets fed by the first feeding unit;

a load thickness detecting unit that detects if thickness of the loaded sheets within the first loading unit reaches a certain load thickness, the loaded sheets gradually decreasing according to the sheet feeding performed by the first feeding unit; and a remaining sheet volume calculating unit that, before the load thickness detecting unit detects that the thickness of the loaded sheets within the first loading unit has reached the certain load thickness, calculates remaining sheet volume based on the lift-up time by the lift-up motor and, after the load thickness detecting unit detects that the thickness of the loaded sheets within the first loading unit has reached the certain load thickness, calculates remaining sheet volume by sequentially subtracting the sheet thickness detected by the sheet thickness detecting unit from the certain load thickness detected by the loading thickness detecting unit, each time the sheet is fed by the first feeding unit.

2. The remaining sheet volume detecting apparatus according to claim 1, wherein the certain load thickness detected by the load thickness detecting unit is thinner than thickness of a maximum load volume of sheet of the first loading unit.

3. A remaining sheet volume detecting apparatus, comprising:

a first loading unit that loads sheets;

a first moving unit that moves the first loading unit to a feeding position of one of the loaded sheets;

a first feeding unit that feeds the one of the loaded sheets from a top position of the first loading unit which has reached the feed position;

a lift-up motor to elevate and lower the first loading unit;

a sheet thickness detecting unit that detects a thickness of the one of the sheets fed by the first feeding unit;

a load thickness detecting unit that detects if thickness of the loaded sheets within the first loading unit reaches a certain load thickness, the loaded sheets gradually decreasing according to the sheet feeding performed by the first feeding unit; and a remaining sheet volume calculating unit that, before the load thickness detecting unit detects that the thickness of the loaded sheets within the first loading unit has reached the certain load thickness, calculates remaining sheet volume based on the lift-up time by the lift-up motor and, after the load thickness detecting unit detects that the thickness of the loaded sheets within the first loading unit has reached the certain load thickness, calculates remaining sheet volume within the first loading unit based on the certain load thickness detected by the load thickness detecting unit and based on the sheet thickness detected by the sheet thickness detecting unit, each time the one of the loaded sheets is fed by the first feeding unit, wherein the sheet thickness detecting unit is configured by a thickness detecting part that detects the sheet thickness based on a rotation angle of a detecting lever, which operates according to the thickness of the sheet fed by the feeding unit.

4. The remaining sheet volume detecting apparatus according to claim 3, further comprising:

a second loading unit; and a second moving unit and a second feeding unit provided in correspondence with the second loading unit, wherein the thickness detecting part is provided in a joint transport path where paper-feed transport paths of the first and the second loading units are joined, the load thickness detecting unit detects that the thickness of the loaded sheet within each loading unit, gradually decreasing according to feeding of sheets within each loading unit performed by each feeding unit, has reached the certain load thickness for each loading unit, the thickness detecting part detects, for each loading unit, the thickness of the sheets fed by each feeding unit from each loading unit, and the remaining sheet volume calculating unit calculates the remaining sheet volume of each loading unit based on the certain load thickness detected by the load thickness detecting unit for each loading unit and the sheet thickness detected by the thickness detecting unit for each loading unit.

5. The remaining sheet volume detecting apparatus according to claim 3, further comprising:

an overlap feed detecting part that detects a thickness of a sheet fed by the feeding unit using a thickness detecting sensor and detects overlap feed in which a plurality of sheets are overlapped and transported based on the detected sheet thickness, wherein the thickness detecting part is configured by the thickness detecting sensor of the overlap feed detecting part.

6. The remaining sheet volume detecting apparatus according to claim 1, wherein the sheet thickness detecting unit is configured by a sheet thickness calculating unit that calculates the sheet thickness based on a movement amount of the first loading unit moved by the first moving unit when one sheet is fed by the first feeding unit.

7. The remaining sheet volume detecting apparatus according to claim 6, wherein the sheet thickness calculating unit detects the movement amount of the first loading unit based on an operation time of a driving unit used to move the first loading unit.

8. An image forming apparatus, comprising:

a first loading unit that loads papers used as a recording medium;

a first moving unit that moves the first loading unit to a feed position of one of the loaded papers;

a first feeding unit that feeds the one of the loaded papers from a top position of the first loading unit which has reached the feed position;

a lift-up motor to elevate and lower the first loading unit;

a paper thickness detecting unit that detects a thickness of the one of the papers fed by the first feeding unit;

a load thickness detecting unit that detects if thickness of the loaded papers within the first loading unit reaches a certain load thickness, the loaded papers gradually decreasing according to the paper feeding performed by the first feeding unit; and a remaining paper volume calculating unit that, before the load thickness detecting unit detects that the thickness of the loaded papers within the first loading unit has reached the certain load thickness, calculation remaining paper volume based on the lift-up time by the lift-up motor and, after the load thickness detecting unit detects that the thickness of the loaded papers within the first loading unit has reached the certain load thickness, calculating remaining paper volume by sequentially subtracting the paper thickness detected by the paper thickness detecting unit from the certain load thickness detected by the loading thickness detecting unit, each time the paper is fed by the first feeding unit.

9. The image forming apparatus according to claim 8, further comprising:

a second loading unit; and a second moving unit and the second feeding unit provided in correspondence with the second loading unit, wherein a thickness detecting part is provided in a joint transport path where paper-feed transport paths of the first and the second loading units are joined, the load thickness detecting unit detects that the thickness of the loaded paper within each loading unit, gradually decreasing according to feeding of papers within each loading unit performed by each feeding unit, has reached the certain load thickness for each loading unit, the thickness detecting part detects, for each loading unit, the thickness of the papers fed by each feeding unit from each loading unit, and the remaining paper volume calculating unit calculates the remaining paper volume of each loading unit based on the certain load thickness detected by the load thickness detecting unit for each loading unit and the paper thickness detected by the thickness detecting unit for each loading unit.

* * * * *